US010562046B2

(12) United States Patent
Jenkins et al.

(10) Patent No.: US 10,562,046 B2
(45) Date of Patent: Feb. 18, 2020

(54) FLOW CONTROL FOR STRAIGHT TIP AND FOG NOZZLE

(71) Applicant: Akron Brass Company, Wooster, OH (US)

(72) Inventors: Jon Jenkins, Wooster, OH (US); Peter Lauffenburger, Orrville, OH (US); Kevin Petit, Wooster, OH (US)

(73) Assignee: Akron Brass Company, Wooster, OH (US)

( * ) Notice: Subject to any disclaimer, the term of this patent is extended or adjusted under 35 U.S.C. 154(b) by 413 days.

(21) Appl. No.: 15/045,700

(22) Filed: Feb. 17, 2016

(65) Prior Publication Data

US 2016/0236213 A1 Aug. 18, 2016

Related U.S. Application Data

(60) Provisional application No. 62/117,078, filed on Feb. 17, 2015, provisional application No. 62/193,918, filed on Jul. 17, 2015.

(51) Int. Cl.
*B05B 1/30* (2006.01)
*B05B 1/12* (2006.01)
(Continued)

(52) U.S. Cl.
CPC ..... *B05B 1/3026* (2013.01); *A62C 31/03* (2013.01); *B05B 1/12* (2013.01); *B05B 1/3073* (2013.01); *B05B 1/06* (2013.01)

(58) Field of Classification Search
CPC ..... A62C 31/02; A62C 31/03; A62C 31/05; B05B 1/06; B05B 1/12; B05B 1/16;
(Continued)

(56) References Cited

U.S. PATENT DOCUMENTS 2,271,800 A * 2/1942 Meussdorffer ..... A62C 31/005 239/441
2,389,642 A * 11/1945 Schellin ..... B05B 1/1681 239/441
(Continued)

FOREIGN PATENT DOCUMENTS

DE 202004016047 U1 1/2005
KR 101282702 B1 7/2013
(Continued)

OTHER PUBLICATIONS

PCT International Search Report and Written Opinion from International Application No. PCT/US2016/021737, dated Jun. 1, 2016, 13 pages.
(Continued)

*Primary Examiner* — Cody J Lieuwen
(74) *Attorney, Agent, or Firm* — Tucker Ellis LLP; Michael G. Craig; Heather M. Barnes

(57) ABSTRACT

One or more techniques and/or systems are disclosed for a dual shutoff nozzle that can mitigate a user positioning a bale handle of the nozzle in an intermediate position to achieve fog flow through the nozzle. A nozzle may be devised that allows the bale to be disposed in a fully closed position, and/or disposed in a fully open position, and to switch between a fog spray and a straight tip flow. The nozzle may comprise a first flow control element, and a shutoff component that controls the first control element. The nozzle can comprise a second flow control element that controls flow between a straight nozzle outlet and a fog pattern outlet; and the second flow control element can be controlled by a pattern sleeve using a rotation motion.

11 Claims, 18 Drawing Sheets

(51) Int. Cl.
*A62C 31/03* (2006.01)
*B05B 1/06* (2006.01)

(58) Field of Classification Search
CPC ..... B05B 1/30; B05B 1/3026; B05B 1/3033; B05B 12/002–0026; B05B 1/3073; F16K 31/5284
USPC ..... 239/443, 530, 444–449, 538, 539, 581.1
See application file for complete search history.

(56) References Cited

U.S. PATENT DOCUMENTS 3,045,927 A * 7/1962 Gilmour ..... B05B 1/12 239/458
3,363,842 A * 1/1968 Burns ..... A62C 31/03 239/441
3,886,967 A 6/1975 Nelson
4,103,744 A 8/1978 Akkerman
4,475,598 A 10/1984 Brakhage, Jr. et al.
4,569,397 A 2/1986 Brakhage, Jr. et al.
6,089,474 A 7/2000 Marino
7,097,120 B2 8/2006 Marino
2001/0045285 A1 11/2001 Russell
2003/0127541 A1* 7/2003 Marino ..... B05B 1/12 239/539
2004/0256497 A1* 12/2004 Sharkey ..... A62C 31/02 239/569
2007/0194148 A1 8/2007 Rosko et al.
2009/0014559 A1* 1/2009 Marino ..... B05B 1/3402 239/514
2011/0204101 A1 8/2011 Jenkins
2013/0256427 A1 10/2013 Steingass et al.
2014/0084083 A1 3/2014 Jenkins et al.
2014/0263754 A1 9/2014 Nushart et al.

FOREIGN PATENT DOCUMENTS

TW 201420151 A 6/2014
WO 99/30828 A1 6/1999

OTHER PUBLICATIONS

China Office Action for Application No. 201680018653X, dated Feb. 2, 2019, 8 pages.
Taiwan Office Action for Application No. 105130964, dated Feb. 10, 2019, 4 pages.
European Patent Office, Extended European Search Report for 16752956.9, date of search Sep. 10, 2018, Munich, 8 pages.

* cited by examiner

FLOW CONTROL FOR STRAIGHT TIP AND FOG NOZZLE

CROSS-REFERENCE TO RELATED APPLICATIONS

This application claims priority to U.S. Provisional Patent Application Ser. No. 62/117,078, entitled FLOW CONTROL FOR STRAIGHT TIP AND FOG NOZZLE, filed Feb. 17, 2015 and U.S. Provisional Patent Application Ser. No. 62/193,918, entitled FLOW CONTROL FOR STRAIGHT TIP AND FOG NOZZLE, filed Jul. 17, 2015, both which are incorporated herein by reference.

BACKGROUND

Current single shutoff combination nozzles are multipurpose fire nozzles with both solid bore penetration and fog stream capability, with controls that provide for a straight stream and fog patterns by positioning a bale handle in an intermediate position to redirect flow from the straight tip flow passage to the fog flow passage. A user can position the bale handle in an orientation that allows the ball, in the ball valve, to direct water flow around the straight tip and into the fog pattern flow area. When the bale handle is positioned in the full open position flow is directed to the straight tip only. When the bale handle is positioned in the full closed position, all flow is stopped from entering the nozzle.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

As provided herein, a single shutoff combination nozzle may mitigate a user's need to position a bale handle in an intermediate position to achieve a fog pattern flow through the nozzle. A nozzle may be devised that allows the bale to be disposed in a fully closed position, and/or disposed in a fully open position. Switching between a fog pattern spray and a straight stream, for example, can be performed using a motion that firefighters are trained to do, such as rotating a pattern sleeve of the nozzle.

In one implementation, a nozzle can comprise a first flow control element that is configured to control a flow of fluid into the nozzle. Further, the nozzle can comprise a second flow control element that is disposed downstream from the first flow control element. The second flow control element can be configured to control the flow of fluid between a straight stream outlet and a fog pattern outlet. Additionally, the nozzle can comprise a pattern sleeve that is operably coupled with the second flow control element. The pattern sleeve can be configured to control the second flow control element using a rotation motion.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein.

DETAILED DESCRIPTION

Figure 1:
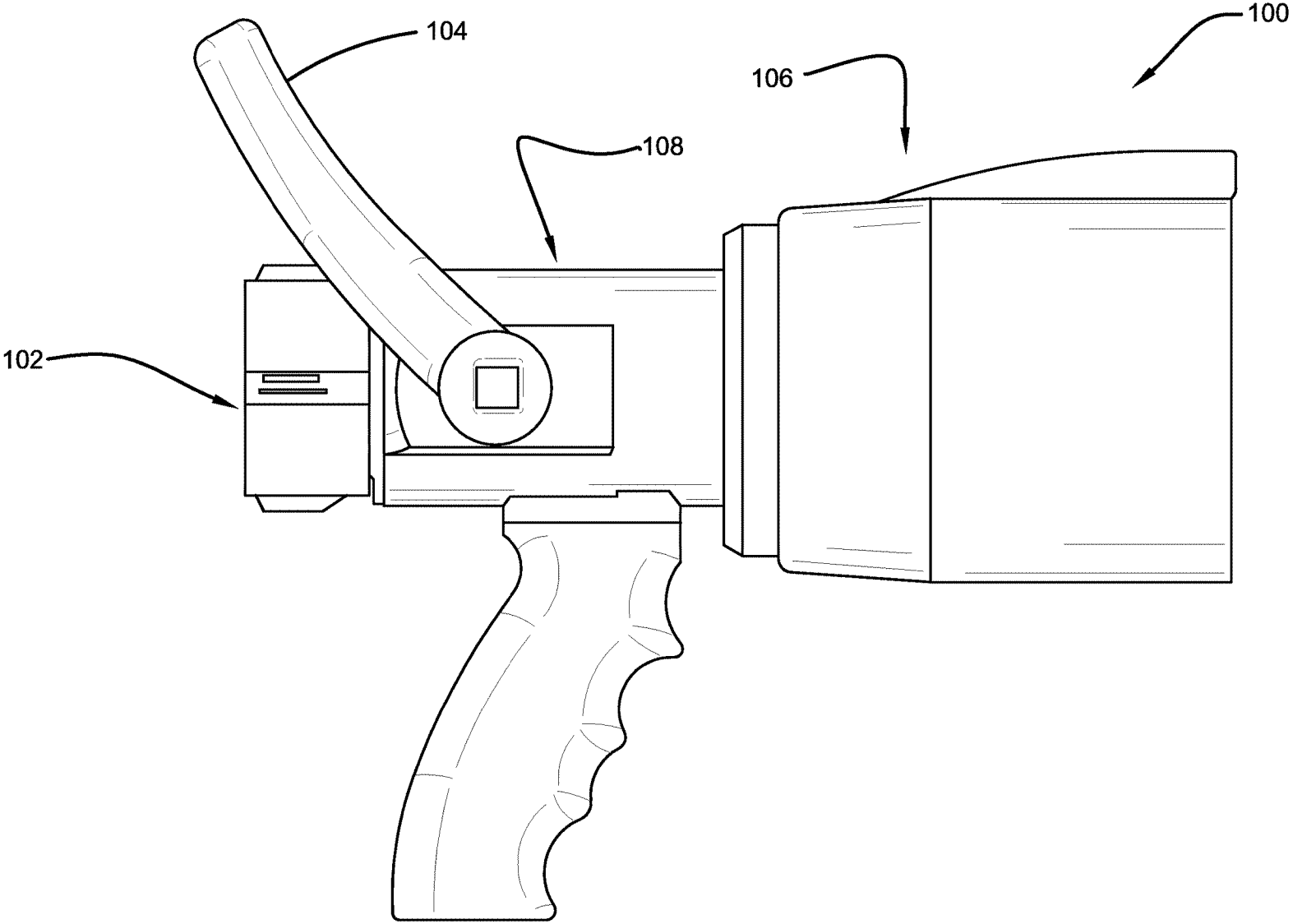
FIG. 1 is a component diagram illustrating a side view of an example implementation of a nozzle.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices may be shown in block diagram form in order to facilitate describing the claimed subject matter.

A nozzle may be devised that comprises both a straight bore outlet and a fog pattern outlet, for example, with the ability to switch between the two outlets using a single motion, common to users of such a nozzle (e.g., firefighters). As an example, the nozzle may have a main flow control element that controls flow of fluid into the nozzle, and a directional flow control element that directs the flow of fluid between the two outlets. Further, in this example, while a typical shutoff bale may be used to move the main flow control element between an opened and closed position, another adjustment component may be used to switch between flow to the straight bore outlet and flow to the fog pattern outlet, where the adjustment component utilizes a typical adjustment motion commonly used by users to adjust a flow pattern of a nozzle, such as by rotating a pattern sleeve.

In one implementation, an example nozzle can comprise a first flow control element that is configured to control a flow of fluid into the nozzle. Further, in this implementation, the example nozzle can comprise a second flow control element disposed downstream from the first flow control element. The second flow control element can be configured to control the flow of fluid between a straight bore outlet and a fog pattern outlet. Additionally, the example nozzle can comprise a shutoff component that is operably coupled with the first flow control mechanism and can be configured to control the first flow control element. In this implementation, the example nozzle can comprise a pattern sleeve that is configured to control the second flow control element and configured to control a fog pattern outlet using a same user motion. In one implementation, the shutoff component may cause shutoff of fluid flow for the nozzle. In another implementation, the shutoff component may cause the flow of fluid to be reduced through the nozzle.

A flow control element may comprise one of the following types: a ball, butterfly, slide, piston, plug, globe, check, gate, and others. The flow control element may take any form chosen in accordance with sound engineering judgment to stop or minimize or decrease fluid flow. In one implementation, one or more of the first flow control element and the second flow control element may comprise a ball-type flow control element ("ball").

Figure 2:
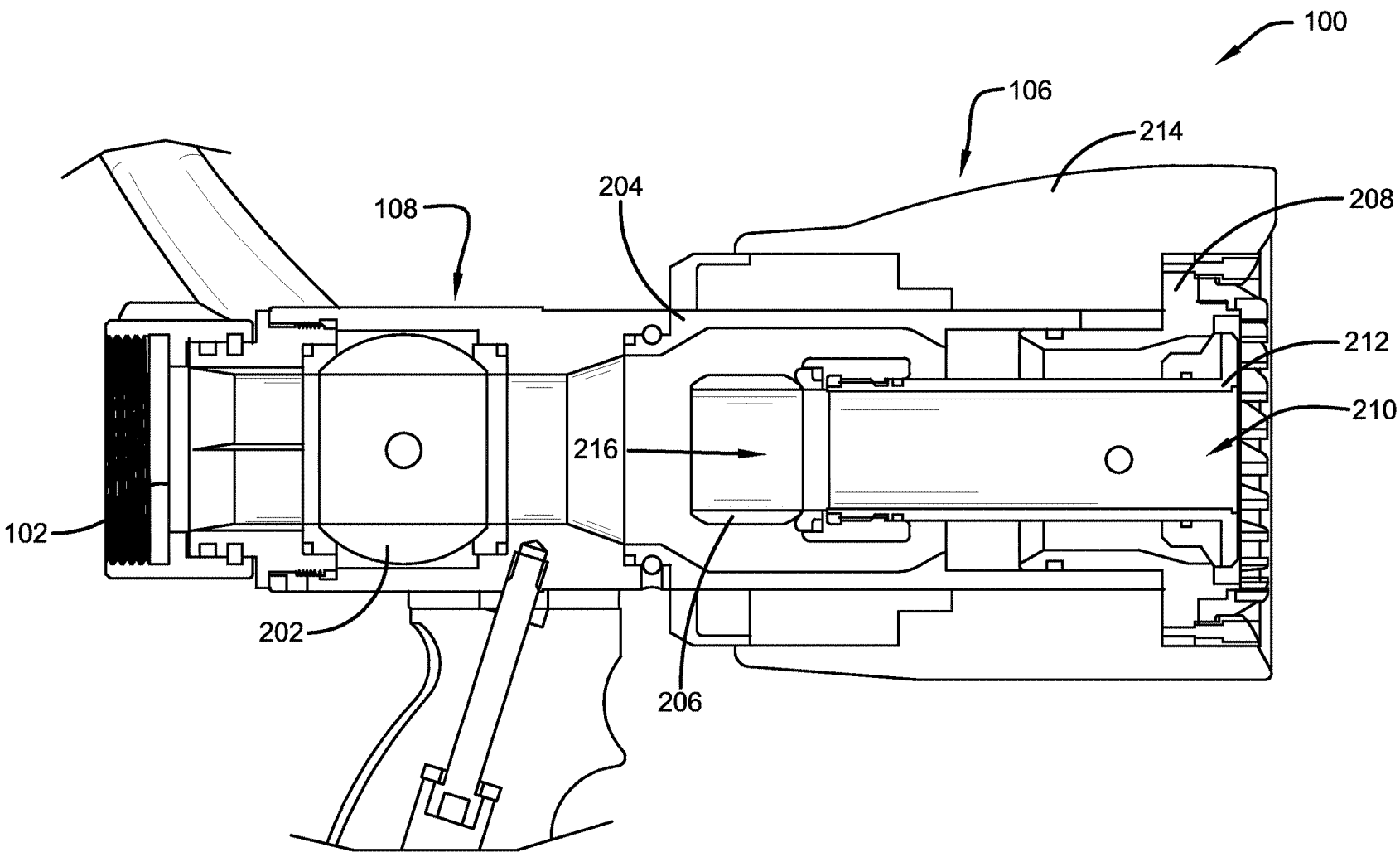
FIG. 2 is a component diagram illustrating a side cut-away view of an example implementation of one or more portions of one or more systems described herein.

With reference to FIGS. 1 and 2, an example nozzle 100 can comprise a fluid inlet 102, comprising the primary fluid inlet for fluids, such as those used for firefighting, cooling, dispensing, or other reasons (e.g., water, foam, chemical mixtures, other fluid products). Further, the exemplary nozzle 100 can comprise a fluid flow actuator 104 (e.g., handle, bale, etc.), which can be operably coupled with the first flow control element 202, and used to control the flow of fluid into the nozzle 100 through the fluid inlet 102. As one example, the first flow control element can comprise a ball component, which can be disposed in a fluid inlet controller 108 portion of the exemplary nozzle 100. Additionally, the exemplary nozzle 100 can comprise a nozzle tip 106, for example, that is coupled with the fluid inlet controller 108 for directing the flow of fluid in a desired manner (e.g., fog pattern and/or straight pattern).

In one implementation, for example, an exemplary nozzle 100 can comprise the first flow control element 202, which may comprise a primary flow controller ball (e.g., shown in the open position in FIG. 2, allowing fluid to flow into the nozzle). Further, in this implementation, a second flow control element 206 can be disposed in a nozzle body 204 in the nozzle tip 106. In FIG. 2, the second flow control element 206 is disposed proximate a fluid inlet 216 to a straight pattern discharge tube 212. As an example, in FIG. 2, the second flow control element 206 is shown in an open position to allow fluid flow to the straight pattern discharge tube 212, and out of a straight pattern outlet 210, comprising a first fluid outlet for the nozzle 100.

Figure 3A:
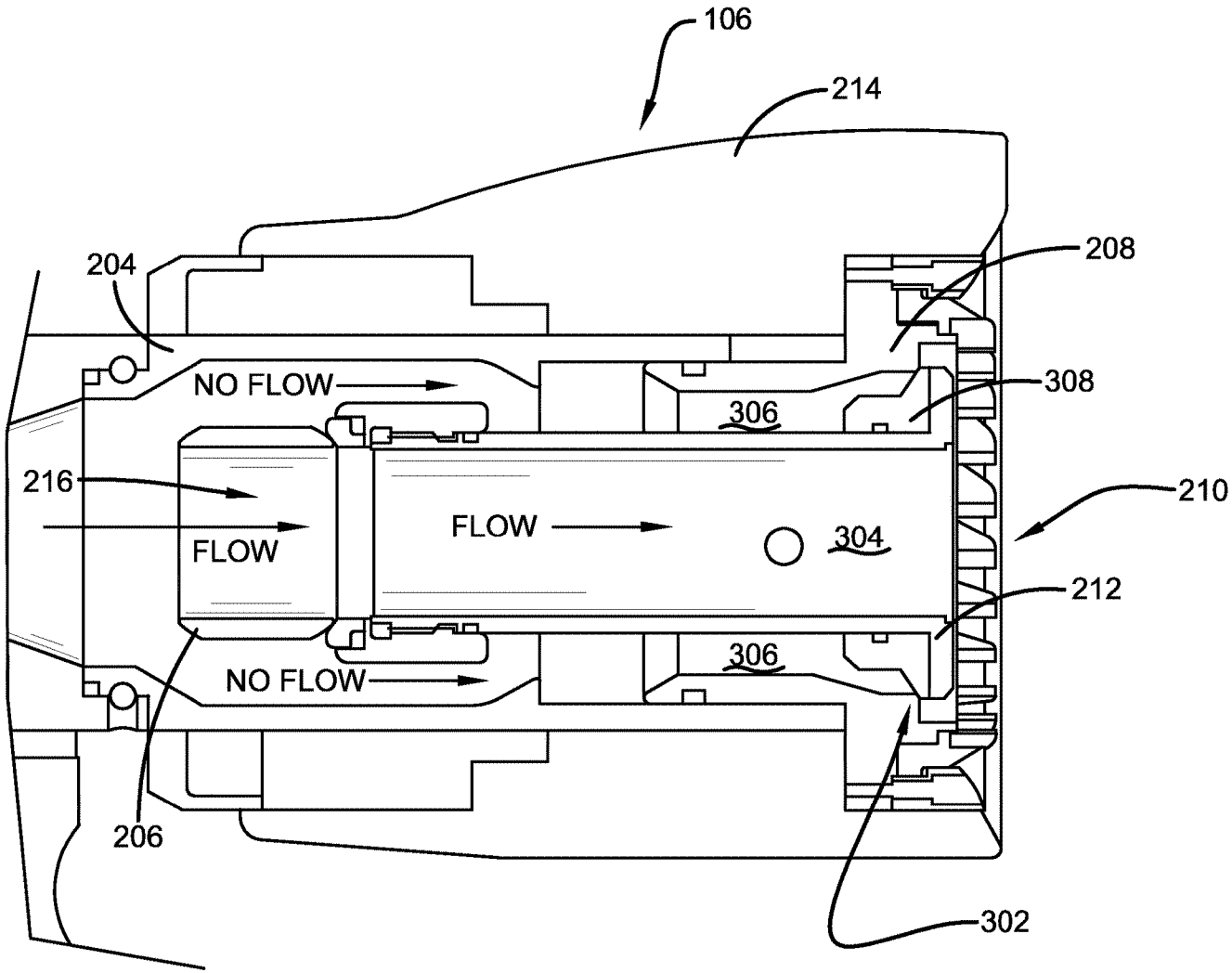
FIGS. 3A and 3B are component diagrams illustrating a sectional view of an example implementation of one or more portions of one or more systems described herein.
Figure 3B:
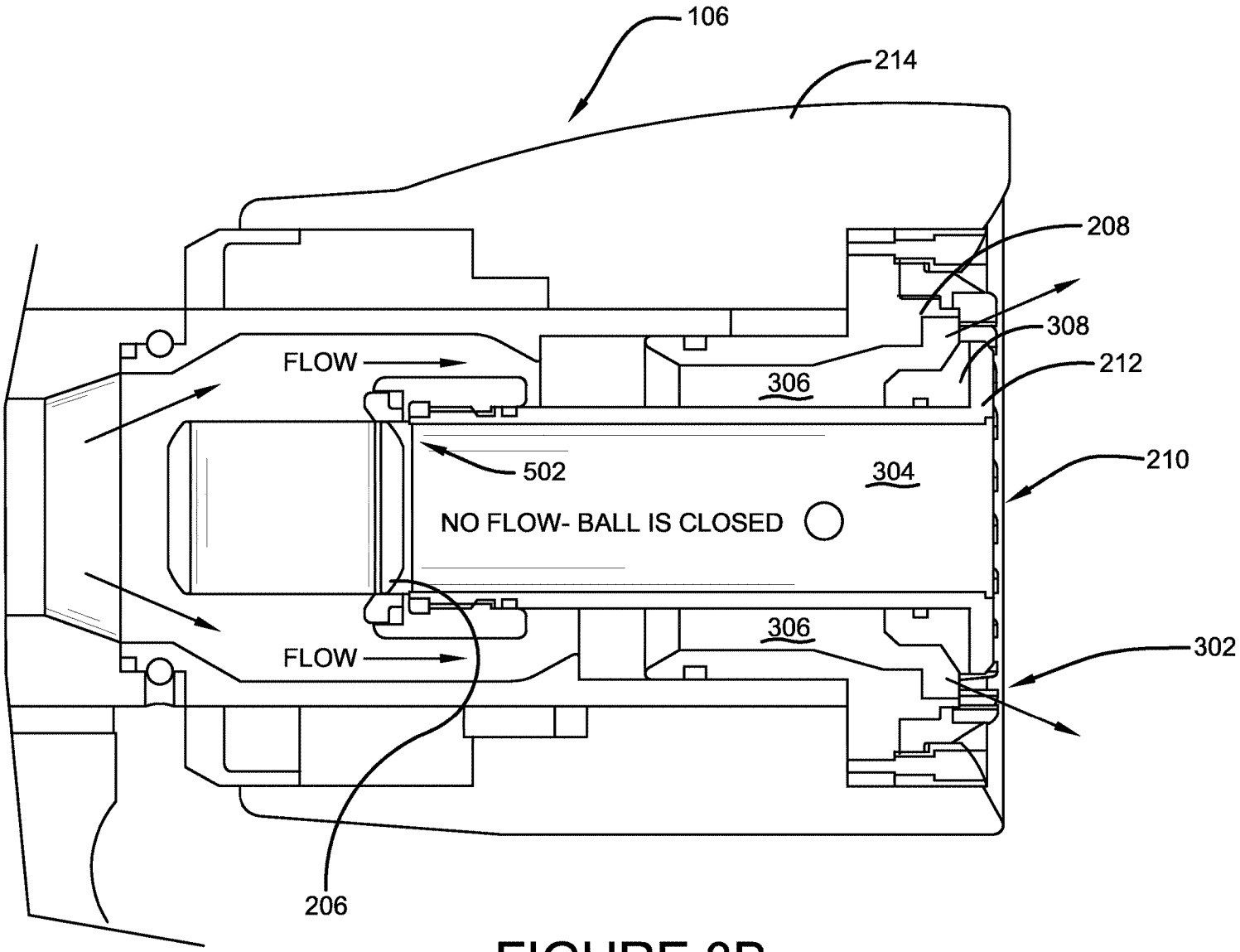

In one implementation, as illustrated in FIGS. 3A and 3B, an example nozzle tip 106 can comprise a straight bore passage 304 (e.g., straight bore tip), which may be configured to provide a generally straight pattern stream of fluid from the straight pattern outlet 210 (e.g., first fluid outlet 210). Further, the example nozzle tip 106 may comprise a fog pattern passage 306. The fog pattern passage may be configured to provide a fog pattern of fluid at the fog pattern outlet (e.g., second fluid outlet), where the fog pattern comprises a wide (e.g., cone-shaped) spray of fluid of varying shapes and angles (e.g., defined by a disposition of a pattern sleeve or discharge tube relative to a baffle).

As an example, the straight bore passage 304, formed by a straight pattern discharge tube 212 of an example nozzle, can comprise a generally straight tube configured to provide a straight path for fluid from inside the nozzle to an outlet portion of the nozzle. In this way, pressurized fluid can be expelled from the nozzle in a generally straight stream pattern. Further, for example, the fog pattern passage 306 can comprise a fog pattern discharge tube 208 (e.g., portion of a pattern sleeve) in combination with a baffle head 308. In this example, as illustrated in FIG. 3B, the fluid flow pattern can be affected by the relationship between the baffle head 308 and the fog pattern discharge tube 208. That is, for example, a shape and disposition of the baffle head 308, and the shape and disposition of the fog pattern discharge tube 208 can cause the fluid to be directed in a cone pattern, where the shape and angle of the cone is a result of the passage 306 created by the baffle head 308 and discharge tube 208, resulting in the fog pattern outlet 302.

Disposing a baffle head (e.g., 308) in a pattern sleeve with a discharge tube (e.g., 208), and adjusting a gap between the discharge tube and baffle, is well known in the art to produce a cone-shaped pattern, often described as a fog pattern. Typically, a pattern sleeve is operably engaged with a discharge tube (e.g., or may be formed together as one component). In one implementation, the pattern sleeve may be driven by a cam insert that is configured to provide a particular distance of pattern sleeve travel when rotation (e.g., one-hundred and eighty degrees) is applied. That is, for example, the cam insert may comprise a thread lead (e.g., or pitch for a single start thread) that provides for pattern sleeve travel, which can allow the pattern sleeve (e.g., and therefore the discharge tube) to extend and retract along the nozzle body, thereby adjusting a position of the discharge tube in relation to a fixed baffle position.

In one implementation, the cam insert can comprise a component that couples the pattern sleeve to the nozzle body, by way of a thread channel that is disposed in the nozzle body. That is, for example, the cam insert may be engaged with the pattern sleeve, and may also be slidably engaged with the thread channel disposed on the exterior of the nozzle body. In this implementation, the thread channel may be disposed around the perimeter of the nozzle body in a thread pattern (e.g., spiral pattern), comprising the desired thread lead. In this example, when a rotational force is applied to the pattern sleeve, such as by rotating an attached bumper engaged with the pattern sleeve, the coupled cam insert can slide rotationally in the thread channel to convert the rotational force into a lateral movement of the pattern sleeve with respect to the nozzle body, and the discharge tube.

In one implementation, as an illustrative example, the switch between straight fluid flow and fog pattern may be achieved by a mechanical connection (e.g., the connection may be mechanical, electrical, electro-mechanical, or pneumatic) between the pattern sleeve and the ball at the base of the straight bore tube. For example, as the pattern sleeve is rotated in a counter-clockwise direction it also has a linear translation towards the inlet end of the nozzle, which is a result of a cam groove design that is often used in nozzles. In this implementation, for example, the mechanical connection between the pattern sleeve and the ball at the base of the straight bore tip can perform the resulting work upon application of both a rotational and linear movement of the pattern sleeve, while still maintaining engagement and causing the ball to rotate between a closed and opened position, depending on a direction of rotation of the pattern sleeve.

Additionally, an amount of rotation to achieve desired closure or desired opening of the straight bore tip ball may be flexible, and may depend on a design of the mechanical connection. In one implementation, a transmission gear design can utilize a gear tooth design and pitch diameter that provides the desired results. In one implementation, the gearing mechanism can be designed so that when the ball is fully closed, the pattern sleeve rotation and linear translation (movement) can continue without the straight bore tip ball rotating any further. In this implementation, for example, this may allow the flow to change to a wide fog position and allow the nozzle to continue to a position known as "flush." For example, flush allows large particles to be ejected from the flow system. In this example, when the pattern sleeve is rotated back from the flush position, the mechanical connection can re-engage at a narrow fog point and the ball in front of the straight bore tip can begin to rotate to the open position. This can redirect the water flow back into the straight bore tip, and the pattern sleeve enters the twist shutoff position which effectively shuts off the water flow to the fog pattern.

Figure 4:
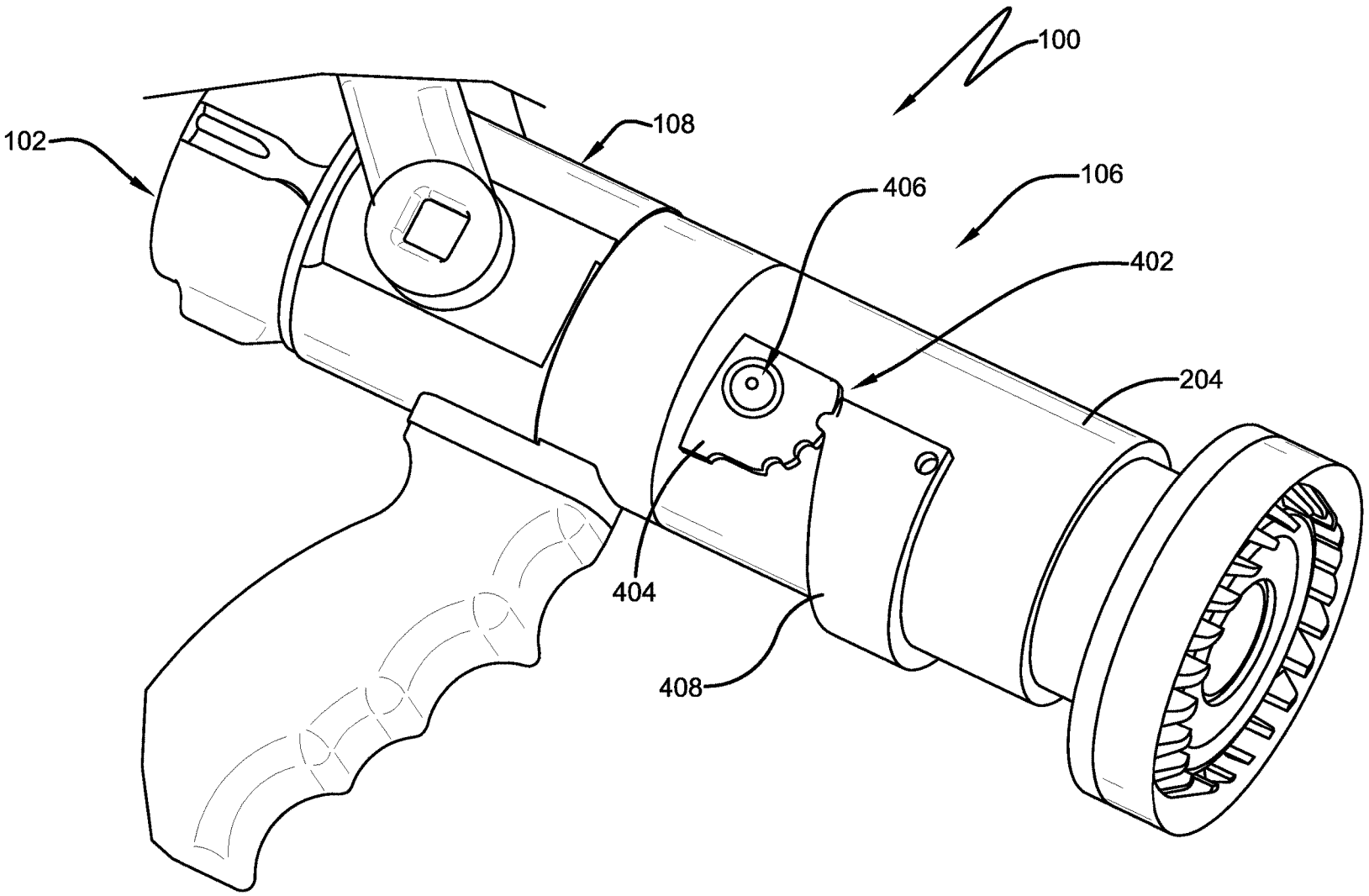
FIG. 4 is a component diagram illustrating a side, perspective view of an example implementation of one or more portions of one or more systems described herein.
Figure 5:
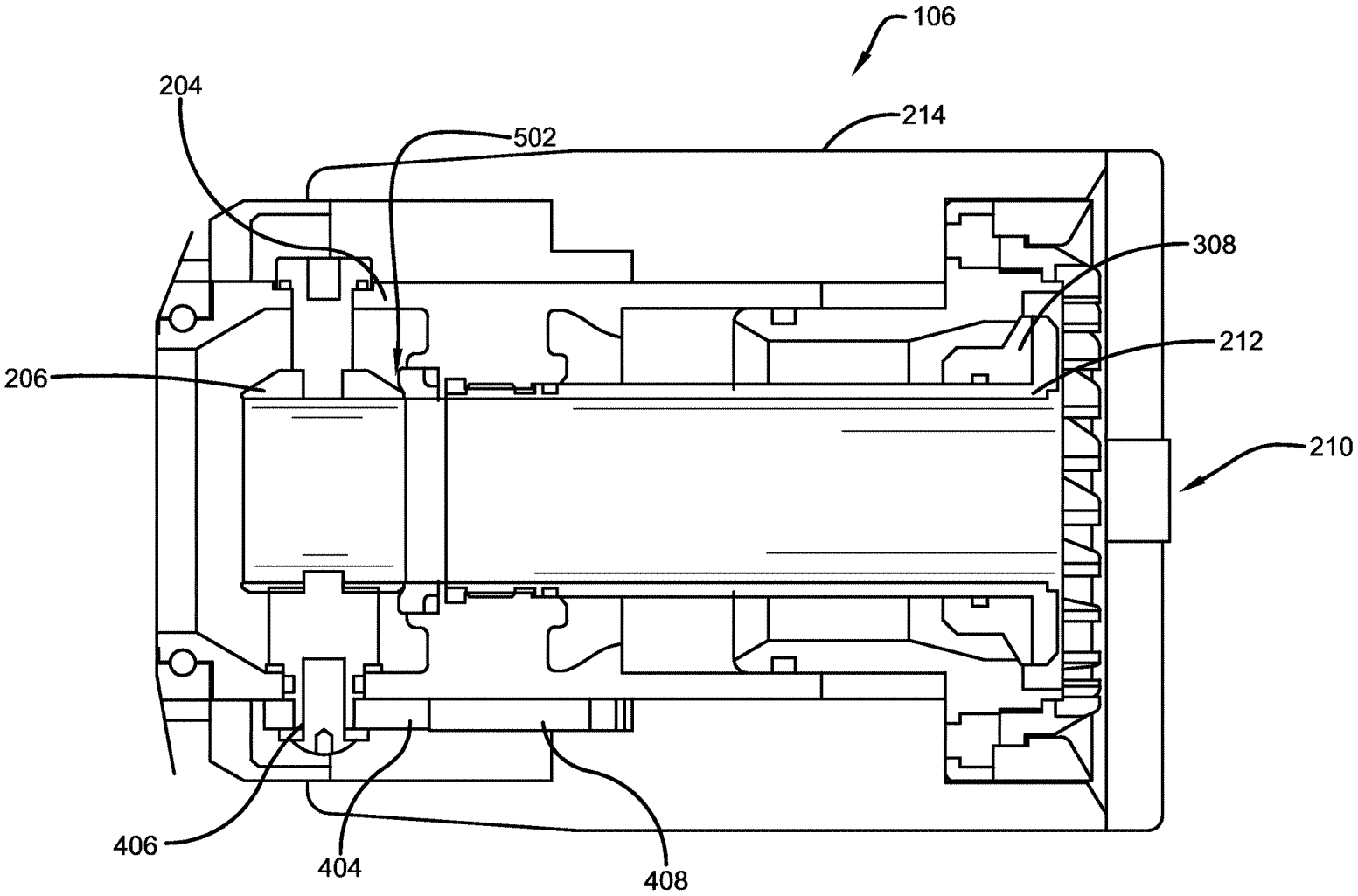
FIG. 5 is a component diagram illustrating a cut-away view of an example implementation of one or more portions of one or more systems described herein.

Further, in one implementation, as illustrated in FIGS. 4 and 5, a transmission actuation component 408 can be engaged with the pattern sleeve 214, such that, rotation of the pattern sleeve 214 can result in translation (e.g., or rotation) of the transmission actuation component 408 with regards to the nozzle body 204. Further, in this implementation, the transmission actuation component 408 can be operably coupled with a transmission 402, such as comprising a sector gear 404 (e.g., or similar), where the translation (e.g., or rotation) of the transmission actuation component 408 results in rotation (e.g., or translation) of the transmission component 402. Additionally, the transmission component 402 can be operably coupled with the second flow control element 206 that is disposed downstream from the first flow control element 202, such as using a trunnion 406 or similar engagement device. In this way, for example, rotation of the transmission component 402 can result in rotation of the trunnion 406, causing rotation of the second flow control element 206 (e.g., ball). For example, the transmission component 402 can transmit action from the pattern sleeve 214 to the second flow control element 206.

As illustrated in FIGS. 3 through 5, in one implementation, rotating the pattern sleeve 214 can result in linear translation of the pattern sleeve 214, for example, which can result in linear translation of the engaged fog pattern discharge tube 208. In this implementation, linear translation of the pattern sleeve 214 can open or close an opening between the baffle head 308 and discharge tube 208, comprising the second fluid outlet 302 (e.g., the fog pattern outlet). In this way, for example, as illustrated in FIG. 3B, fluid can flow through the fog pattern passage 306 to the fog pattern outlet 302.

Further, as described above, rotation of the pattern sleeve can result in moving the second flow control element between the opened and closed position. As shown in FIGS. 3A and 5, the second flow control element 206 is disposed in the open position, and the fog pattern outlet 302 is disposed in a closed position. In this example, the fluid flow can be discharged through the straight pattern outlet 210 (e.g., first fluid outlet). As shown in FIG. 3B, the pattern sleeve 214 has been rotated, causing the second flow control element 206 to move to the closed position, forming a seal at a straight bore seal 502. Additionally, the rotation of the pattern sleeve 214 has resulted in a linear translation of the pattern sleeve 214 rearward, causing an opening between the baffle head 308 and the discharge tube 208, at the fog pattern outlet 302. In this example, the fluid flow can flow through the fog pattern passage 306, and be discharged through the fog pattern outlet 302, resulting in a cone-shaped discharge pattern.

Figure 6A:
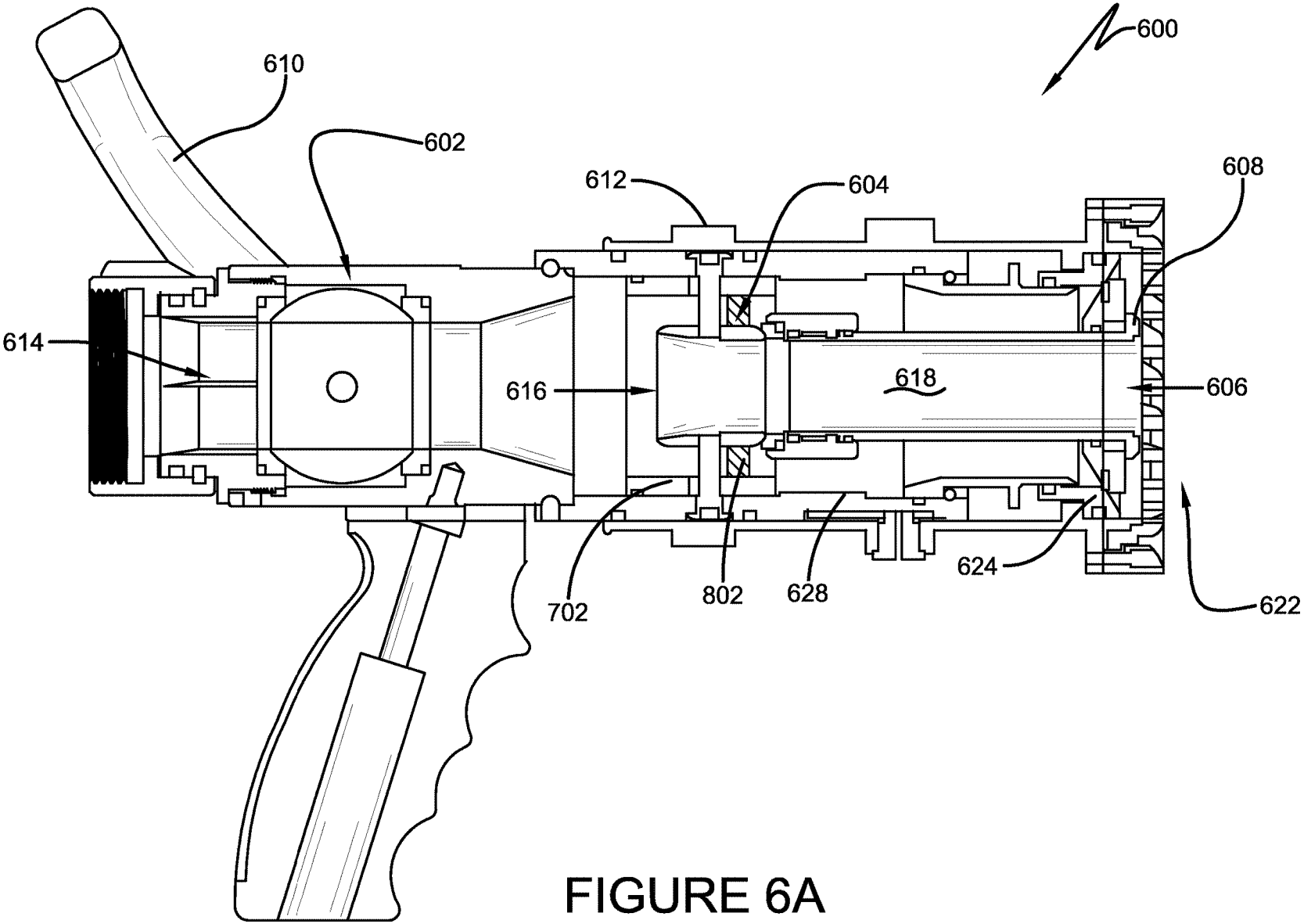
FIGS. 6A, 6B, and 6C are component diagrams illustrating a side, cut-away view of an example implementation of one or more portions of one or more systems described herein.
Figure 6B:
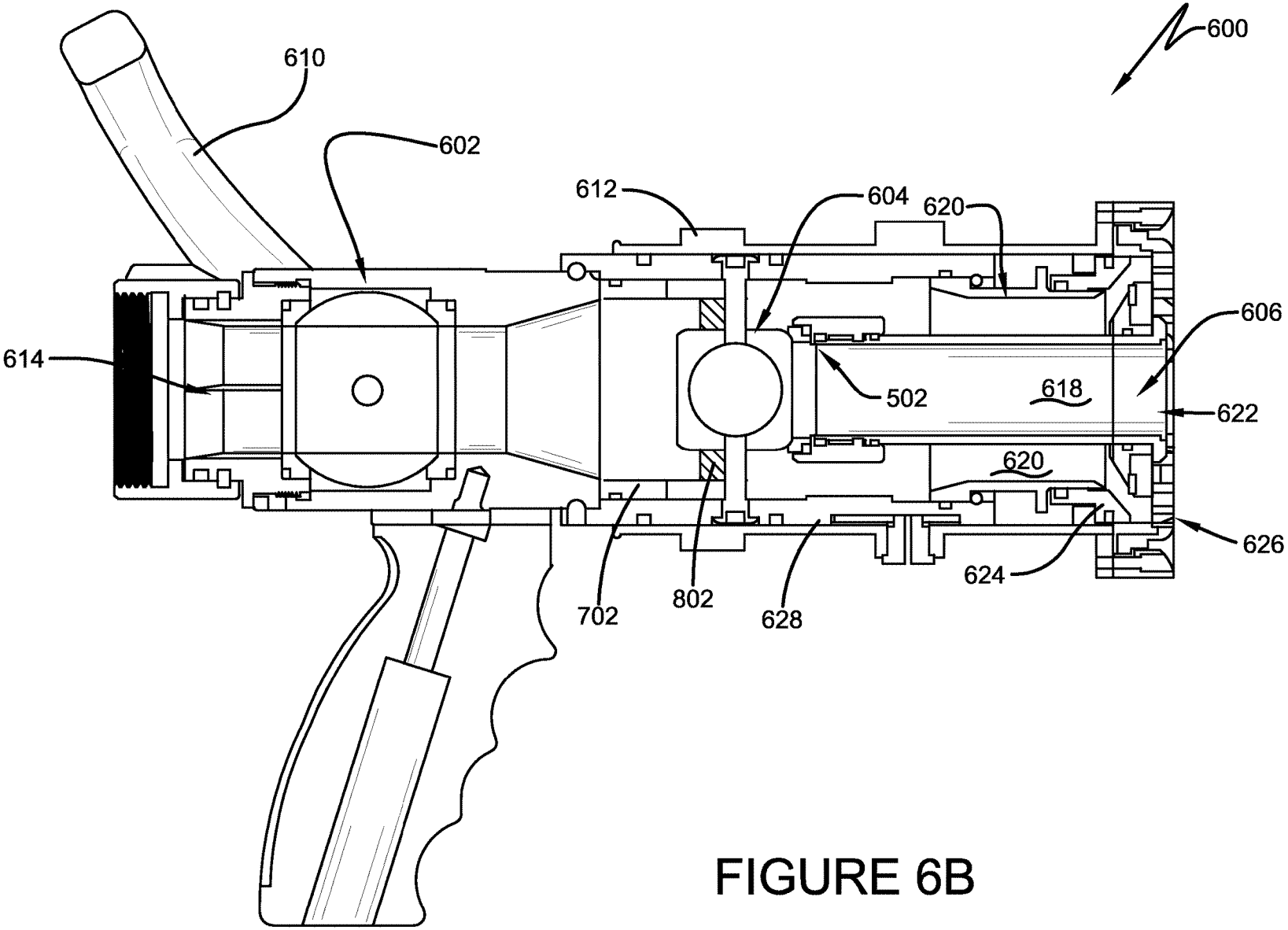
Figure 6C:
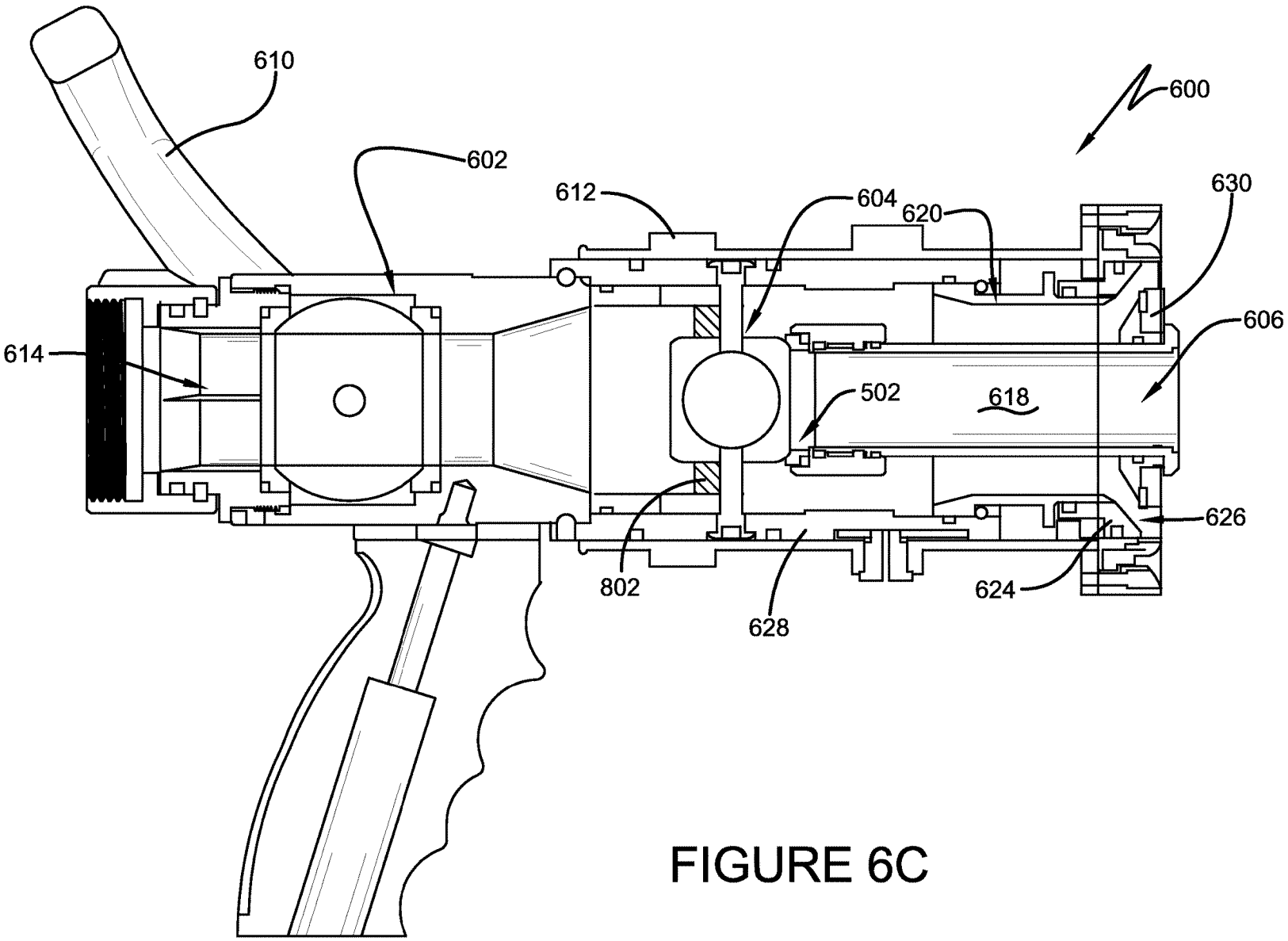

As illustrated in FIGS. 6A, 6B, and 6C, in one implementation, an example nozzle 600 can comprise a first flow control element 602 that is configured to control a flow of fluid into the nozzle 600. Further, in this implementation, the example nozzle 600 can comprise a second flow control element 604 disposed downstream from the first flow control element 602. The second flow control element 604 can be configured to control the flow of fluid between a straight bore outlet 606 and a fog pattern outlet 626. Additionally, the example nozzle 600 can comprise a shutoff component 610 that is operably coupled with the first flow control element 602 and can be used to control the first flow control element 602. In this implementation, the example nozzle 600 can comprise a pattern sleeve 612 that is configured to control the second flow control element 604, and configured to control a fog pattern outlet 626 using a same user motion. In one implementation, the shutoff component 610 may be used to shutoff of fluid flow for the nozzle 600, by closing (e.g., and opening to introduce flow) the first flow control element 602, thereby mitigating flow from a main fluid inlet 614. In another implementation, the shutoff component 610 may cause the flow of fluid to be reduced through the nozzle 600, for example, by partially opening or closing the first flow control element 602.

As an example, a fluid flow control element used in a nozzle can comprise one of the following types: a ball, butterfly, slide, piston, plug, globe, check, gate, and others. The flow control element may take any form chosen in accordance with sound engineering judgment to mitigate or decrease fluid flow through a nozzle. In one implementation, one or both of the first flow control element 602 and the second flow control element 604 may comprise a ball-type flow control element ("ball") (e.g., as depicted in FIGS. 3A-3C). In this implementation, for example, a first ball (e.g., 602) can be disposed proximate the main fluid inlet 614 to the nozzle 600, as illustrated in FIGS. 6A-C, illustrating an example primary flow shutoff ball, shown in the open position (e.g., allowing fluid to flow into the nozzle). Further, in this implementation, a second ball (e.g., 604) can be disposed proximate an upstream fluid inlet 616 to a straight bore passage 618 of the nozzle 600, as illustrated in FIG. 6A. FIG. 6A illustrates the example second ball (e.g., 604) shown in an open position to allow fluid flow to the straight bore passage 618. FIGS. 6B and 6C illustrate the example second ball (e.g., 604) shown in a closed position, mitigating fluid flow to the straight bore passage 618 at a seal 502 created between the second ball 604 and the inlet portion of the straight pattern discharge tube 608.

In one implementation, as illustrated in FIGS. 6A-C, an example nozzle 600 can comprise a straight bore passage 618 (e.g., defined by the straight bore pattern discharge tube 608), which may be configured to provide a generally straight pattern stream of fluid from the straight bore outlet 606 (e.g., at the outlet of the nozzle). Further, an example nozzle 600 may also comprise a fog pattern passage 620, as shown in FIGS. 6B and 6C. The fog pattern passage 620 may be configured to provide a fog pattern spray at the fog pattern outlet 626 of the fog pattern passage 620, where the fog pattern spray may comprise a wide (e.g., cone-shaped)

spray of fluid of varying shapes and angles (e.g., defined by a disposition of a pattern sleeve 612 relative to a baffle head 630).

As an example, the straight bore passage 618 of the example nozzle 600 can comprise a generally straight tube configured to provide a straight path for fluid from inside the nozzle 600 to an outlet portion 622 of the nozzle 600. In this way, pressurized fluid can be expelled from the nozzle 600 in a generally straight stream pattern. Further, for example, the fog pattern passage 620 can comprise a fog pattern discharge tube 624 and pattern sleeve 612 in combination with the baffle head 630. In this example, as illustrated in FIGS. 6B and 6C, the fluid flow pattern can be affected by the relationship between the baffle head 630 and the discharge tube 624 portion of the pattern sleeve 612. That is, for example, a shape and disposition of the baffle head 630, and the shape and disposition of the discharge tube 624 portion of the pattern sleeve 612 can cause the fluid to be directed in a cone pattern, where the shape and angle of the cone is a result of the passage created by the baffle head 630, the pattern sleeve 612, and discharge tube 624, at the fog pattern outlet 626.

Disposing a baffle head 630 in the pattern sleeve 612, with a discharge tube 624, and adjusting a gap (e.g., fog pattern outlet 626) between the discharge tube 624 and baffle head 630, and length of overhang of the pattern sleeve 612 is well known in the art to produce a cone-shaped pattern, often described as a fog pattern. A pattern sleeve 612 may be operably engaged with a discharge tube 624; or the pattern sleeve 612 may be formed together with the discharge tube 624. In one implementation, the pattern sleeve 612 may be driven by a cam insert that is configured to provide a particular distance of pattern sleeve travel when a desired amount of rotation (e.g., one-hundred and eighty degrees) is applied. That is, for example, the cam insert may comprise a thread lead (e.g., or pitch for a single start thread) that provides for pattern sleeve travel, which can allow the pattern sleeve 612 to extend and retract along the nozzle body 628, thereby adjusting a position of the discharge tube 624 in relation to a fixed baffle position.

In one implementation, the cam insert can comprise a component that couples the pattern sleeve 612 to the nozzle body 628, by way of a thread channel that is disposed in the nozzle body 628. That is, for example, the cam insert may be engaged with the pattern sleeve 612, and may also be slidably engaged with the thread channel disposed on the exterior of the nozzle body 628. In this implementation, the thread channel may be disposed around the perimeter of the nozzle body 628 in a thread pattern (e.g., spiral pattern), comprising the desired thread lead. In this example, when a rotational force is applied to the pattern sleeve 612, such as by rotating an attached bumper engaged with the pattern sleeve 612, the coupled cam insert can slide rotationally in the thread channel to convert the rotational force into a lateral movement of the pattern sleeve 612 with respect to the nozzle body 628, and the discharge tube 624.

Figure 7A:
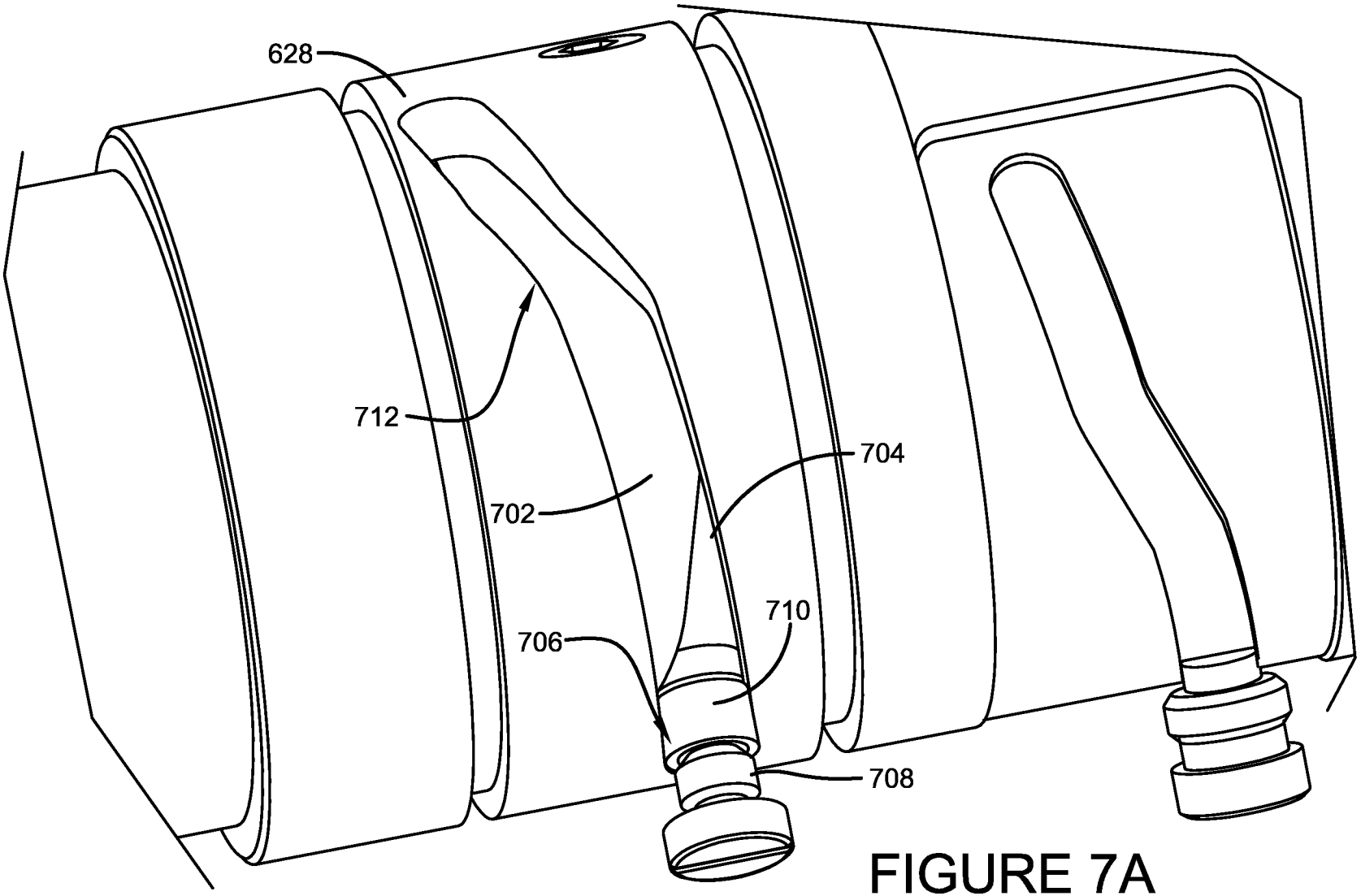
FIGS. 7A and 7B are component diagrams illustrating a side, sectional view of an example implementation of one or more portions of one or more systems described herein.
Figure 7B:
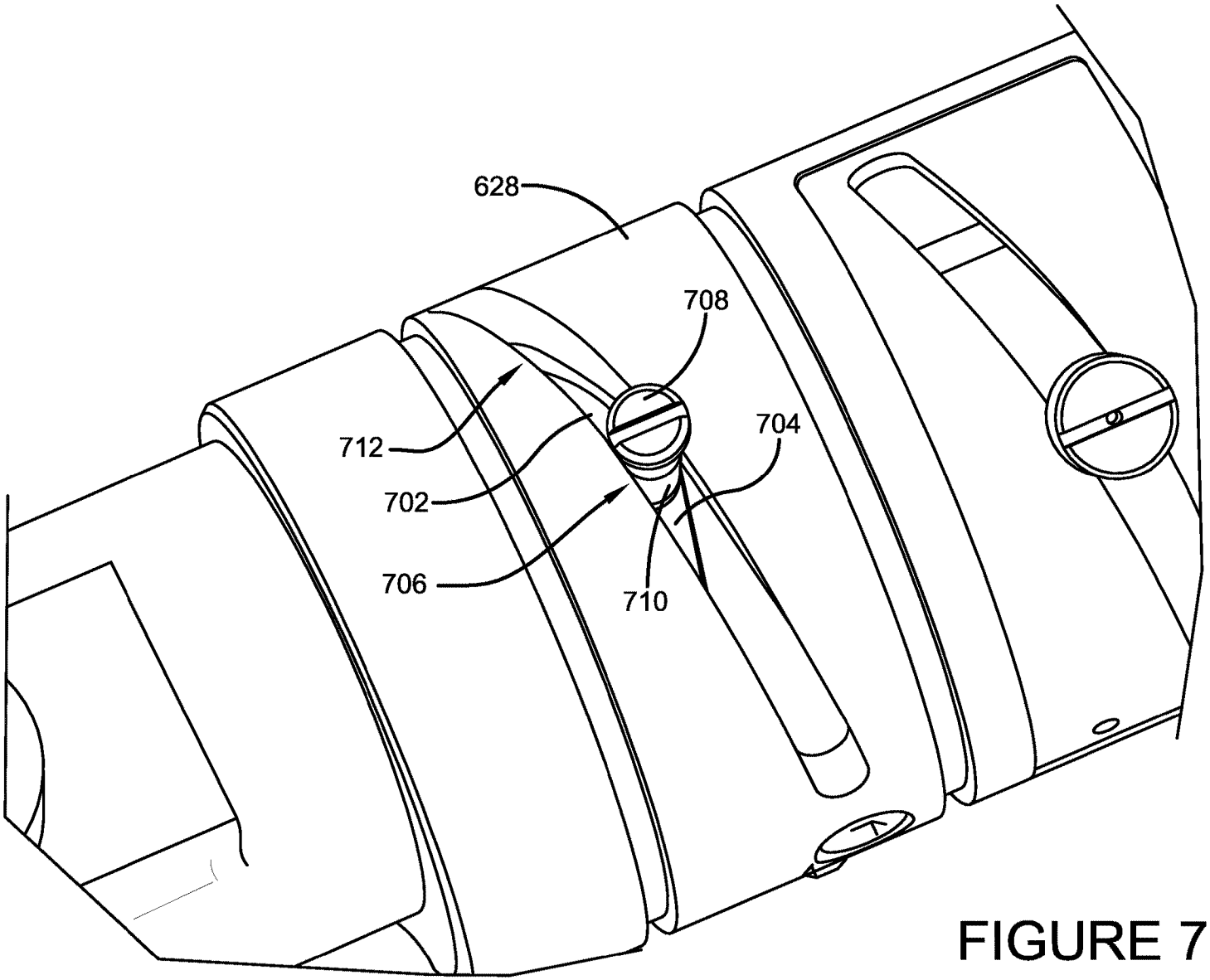
Figure 8:
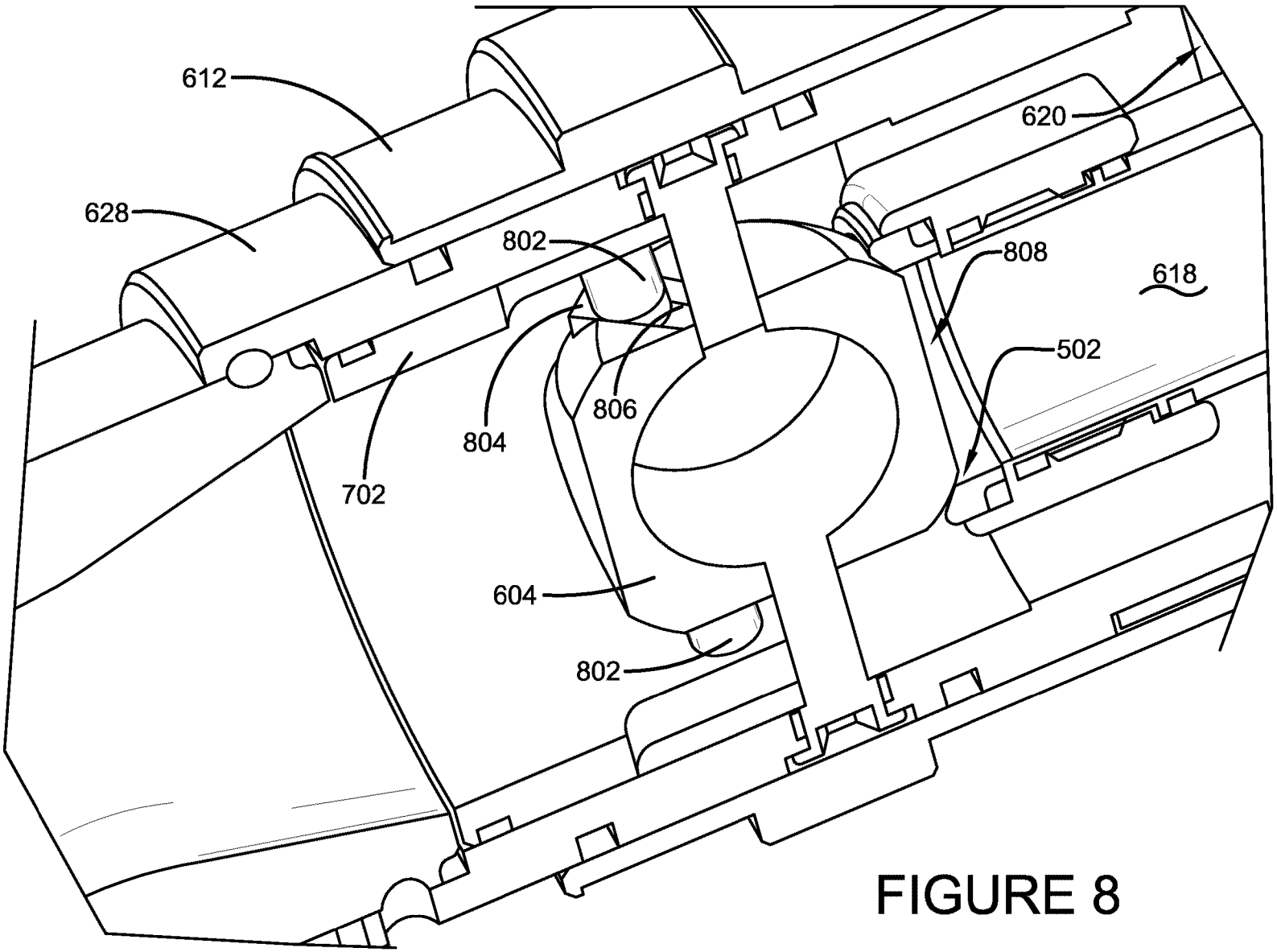
FIG. 8 is a component diagram illustrating a side, cut-away view of an example implementation of one or more portions of one or more systems described herein.

Further, in one aspect, as illustrated in FIGS. 7A, 7B, and 8, with continued reference to FIGS. 6A-6C, a second flow control element 604 can operably couple with the pattern sleeve 612, such that, rotation applied to the pattern sleeve 612 can result in rotation (e.g., or translation) of the second flow control element 604 with regards to the nozzle body 628. In one implementation, in this aspect, the second flow control element 604 can be operably coupled with a control element actuator 702. For example, in this implementation, the control element actuator 702 can comprise at least one actuator connector 802 that is configured to couple the control element actuator 702 with the second flow control element 604.

Further, in this implementation, as illustrated in FIG. 8, for example, the actuator connector 802 may be coupled with the second flow control element 604 offset from an axis of rotation of the second flow control element 604. In this way, for example, when the control element actuator 702 is translated linearly along an axis of fluid flow, the offset coupling disposition of the actuator connector 802, in relation to the axis of rotation of the second flow control element 604, can apply torque (e.g., a rotation force) to the second flow control element 604, resulting in rotation of the second flow control element 604 around its axis of rotation. In this implementation, the control element actuator 702 can be linearly translated between a first position and a second position in the nozzle body 628. In one implementation, the actuator connector 802 may be coupled with a connector support insert 804 that is configured to translate radially within a control element channel 806 disposed in the surface of the second control element 604. In this way, for example, the actuator connector 802 may be able to translate linearly along the axis of fluid flow, as a result of the connector support insert 804 sliding within the radially disposed control element channel 806 during rotation of the second flow control element 604 around the axis of rotation.

As an illustrative example, in FIGS. 6B and 8, the control element actuator 702 is translated to a first position, in an upstream direction from the outlet portion 622 (e.g., toward the main inlet 614, or rearward position). In this example, the second flow control element 604 is disposed in a closed position, which mitigates fluid flow into the straight bore passage 618 of the nozzle 600. Further, when the second flow control element 604 is disposed in a closed position, fluid flow can be directed (e.g., around the second flow control element 604) to the fog pattern passage 620 (e.g., and to the fog pattern outlet 626) of the nozzle. As another illustrative example, in FIG. 6A, the control element actuator 702 is translated to a second position, in a downstream direction (e.g., toward the outlet portion 622, away from the main inlet 614, or forward position). In this example, the second flow control element 604 is disposed in an open position, which allows fluid flow into the straight bore passage 618 of the nozzle 600 (e.g., and to the straight pattern outlet 606).

In one aspect, switching between the straight stream pattern and the fog spray pattern can be achieved by using the second flow control element 604 (e.g., second ball), disposed upstream from and entrance to the straight stream discharge tube 608. In this aspect, for example, the second flow control element 604 can be mechanically coupled to the pattern sleeve 612 of the nozzle 600, such that when the pattern sleeve 612 is rotated (e.g., clockwise, to the right) the second flow control element 604 is opened and the fog pattern outlet 626 (e.g., or second fluid outlet) is closed. In this example, the fog spray pattern outlet 626 can be closed (e.g., fully) by a method often referred to as a twist shutoff. Further, in this aspect, for example, when the pattern sleeve 612 is rotated in the other direction (e.g., in a counterclockwise direction, to the left), the twist shutoff can begin to open, which may allow fluid to flow through the fog pattern passage 620. At the same time, for example, the second flow control element 604 can begin to rotate to a closed position against the seal 502, mitigating the fluid flow to the straight bore passage 618.

In one aspect, the switch between straight stream pattern fluid flow and fog spray pattern may be achieved by a coupling (e.g., the connection may be mechanical, electrical, electro-mechanical, or pneumatic) between the pattern sleeve 612 and the second flow control element 604. For example, rotating the pattern sleeve 612 in a counter-clockwise direction around the nozzle body 628, the pattern sleeve 612 may also translate linearly toward the inlet end of the nozzle 600. This type of linear and rotational translation can be achieved using a cam groove design that is often used in nozzles. In one implementation, in this aspect, the coupling between the pattern sleeve 612 and the second flow control element 604, in combination with the application of both a rotational and linear movement of the pattern sleeve 612, may be used to apply a translation force to the second flow control element 604. In this way, for example, the second flow control element 604 can be translated between a first (e.g., closed) position and a second (e.g., opened) position using the same pattern sleeve rotation motion, depending on a direction of rotation of the pattern sleeve 612.

In this aspect, an amount of rotation of the pattern sleeve 612 used to achieve a desired closure or desired opening of the second flow control element 604 may be varied. For example, the design of the coupling between the pattern sleeve 612 and the second flow control element 604 can determine the amount of pattern sleeve rotation used to open or close the second flow control element 604. In one implementation, as illustrated in FIGS. 7A, 7B, and 8, the control element actuator 702 may comprise an actuator channel 704 disposed at the outer surface of the control element actuator 702. As an example, the actuator channel 704 can be disposed in a generally spiral configuration (e.g., comprising a desired spiral pitch) around the outer surface of the control element actuator 702, where the spiral configuration is configured to convert rotational translation of the pattern sleeve 612 into a desired amount of linear translation of the control element actuator 702. That is, for example, a distance of rotation of the pattern sleeve 612 can result in the desired distance of linear translation of the control element actuator 702 along the axis of fluid flow (e.g., between the first position and second position, depending on the pitch of the actuator channel 704).

In one implementation, as illustrated in FIGS. 7A and 7B, a sleeve-actuator coupler 706 can be operably coupled with the pattern sleeve 612 and configured to operably engage with the control element actuator 702, such as in the actuator channel 704. As an example, the sleeve-actuator coupler 706 can comprise a pin component 708 and a roller component 710 (e.g., a roller pin assembly). In this implementation, the pin component 708 can be operably engaged with the pattern sleeve 612, such that when the pattern sleeve 612 is translated rotationally the pin component 708 can also be rotationally translated a proportional distance. In this implementation, the roller component 710 can be configured to operably couple with the control element actuator 702 in the actuator channel 704, in slideable and/or a roller-like manner, such that, when the pin component 708 is translated, the roller component 710 can slide and/or roll along the actuator channel 704.

Further, as illustrated in FIGS. 7A and 7B, in one implementation, the nozzle body 628 can comprise a body channel 712. The body channel 712 can be disposed in the nozzle body 628, and configured to receive the sleeve-actuator coupler 706, and to guide the sleeve-actuator coupler 706 along a desired path when the pattern sleeve 612 is rotationally translated. That is, for example, the sleeve-actuator coupler 706 can be configured to slide and/or roll within the body channel 712 when the pattern sleeve 612 is rotationally translated, which, in turn, results in the sleeve-actuator coupler 706 sliding and/or rolling within the actuator channel 704. In this way, for example, the desired path of the body channel 712 can determine the linear translation of the control element actuator 702.

For example, as illustrated in FIGS. 7A and 7B, when the pattern sleeve 612 is rotated counterclockwise (e.g., from the user's position) the sleeve-actuator coupler 706 slides or rolls along the path of the body channel 712. In this example, the action of the sleeve-actuator coupler 706 and the body channel 712 results in translation of the sleeve-actuator coupler 706 both counterclockwise and linearly rearward; as the path of the body channel 712 is configured in these directions. Additionally, in this example, as the sleeve-actuator coupler 706 is translated linearly rearward, the roller component 710 slide and/or rolls in the actuator channel 704, which can be disposed in a spiral pattern. In this example, as the roller component 710 slides and/or rolls in the actuator channel 704, the spiral pattern of the channel results in a linear translation of the control element actuator 702 rearward. As described above, translation of the control element actuator 702 rearward can result in moving (e.g., rotating) the second flow control element 604 from an open to a closed position. This, in turn, may shift fluid flow from the straight stream passage 618 to the fog spray pattern passage 620, for example.

In one implementation, the length and/or pitch of the actuator channel 704 and the body channel 712 (e.g., or transmission 402), in conjunction with the pattern sleeve 612 and nozzle body 628, can be configured to such that when the ball (e.g., 604) is fully closed, the pattern sleeve rotation and linear translation (movement) can continue without the second ball (e.g., 604) rotating any further (e.g., remaining closed, with the control actuator element 702 remaining stationary). In this implementation, for example, this may allow the flow to change to a wide fog position and allow the nozzle to continue to a position known as "flush." For example, flush allows large particles to be ejected from the flow system. In this example, when the pattern sleeve 612 is rotated back from the flush position, the coupling (e.g., mechanical connection) can re-engage at a narrow fog point and the ball (e.g., 604) in front of the straight bore tip portion 618 can begin to rotate to the open position. This can redirect the water flow back into the straight stream passage 618, and the pattern sleeve 612 enters the twist shutoff position, which effectively shuts off the water flow to the fog pattern outlet 626.

In one implementation, as illustrated in FIGS. 6A, 6B and 6C, rotating the pattern sleeve 612 can result in linear translation of the pattern sleeve 612, for example, while a coupled discharge tube 624 remains stationary relative to the nozzle body 628. In this implementation, linear translation of the pattern sleeve 612 can change the opening between the baffle head 630 and pattern sleeve 612, between open and closed. The opening created between the baffle head 630 and pattern sleeve 612 can form the fog pattern outlet 626. Further, as described above, rotation of the pattern sleeve 612 can result in moving the second flow control element 604 between the opened and closed position. As shown in FIG. 6A, the second flow control element 604 is disposed in the open position, and the opening between the baffle head 630 and pattern sleeve 612, comprising the fog pattern outlet 626, is disposed in a closed position. In this example, the fluid flow can be discharged through the straight bore outlet 618. As shown in FIGS. 6B and 6C, the pattern sleeve 612 has been rotated, resulting in linear translation of the pattern sleeve rearward. Further, the second flow control element 604 has moved to the closed position. Additionally, the linear translation of the pattern sleeve 612 rearward, has resulted in the opening the fog pattern outlet 626. In this example, the fluid flow can be discharged through the fog pattern passage 620 to the fog pattern outlet 626, resulting in a cone-shaped discharge pattern.

Figure 9A:
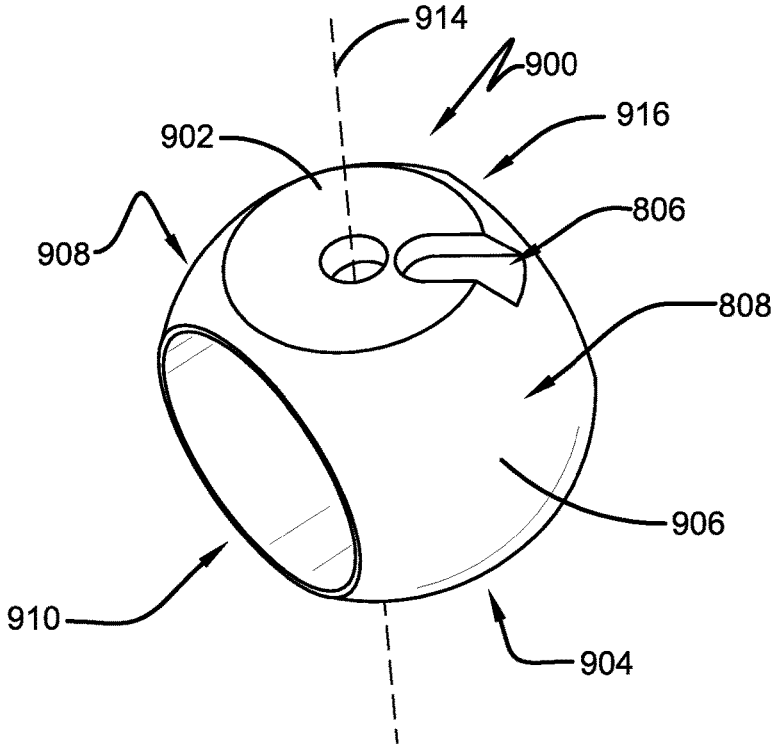
FIGS. 9A and 9B are component diagrams illustrating a perspective view of an example implementation of one or more portions of one or more systems described herein.
Figure 9B:
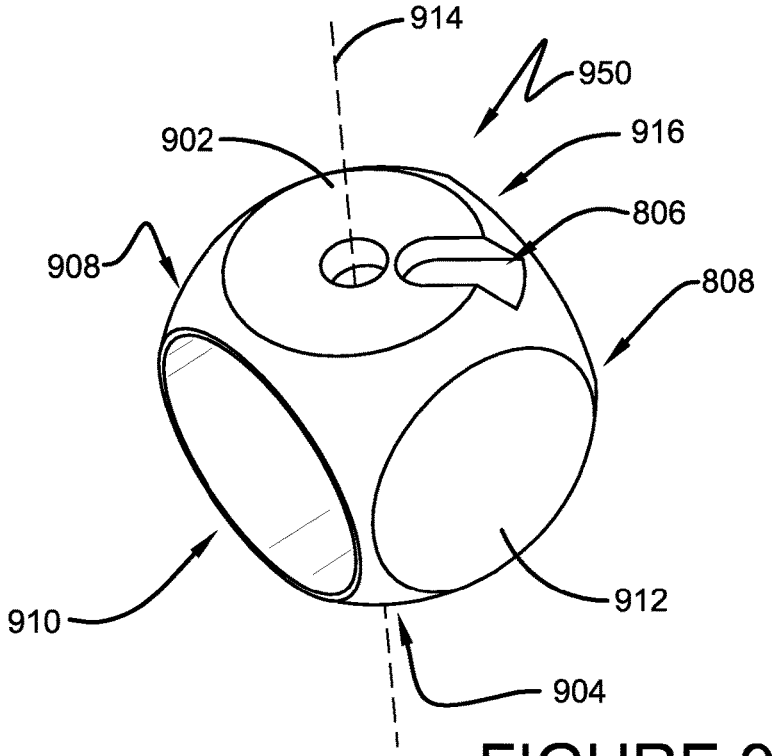

FIGS. 9A and 9B are component diagrams illustrating exemplary flow control elements 900, 950, which may be implemented by one or more methods or systems described herein. For example, the exemplary flow control elements may be used for the second flow control element 604 disposed in the exemplary nozzle 600. In this implementation, the respective flow control elements 900, 950 comprise a fluid inlet side 910 and a fluid outlet side 916. Further, the respective flow control elements 900, 950 comprise a top side 902 and a bottom side 904, where the top side (e.g., and/or bottom side 904) comprise the control element groove 806 described above in FIG. 8. Additionally, the flow control elements 900, 950 comprise a fluid sealing side 808 and a non-sealing side 908; and an axis of rotation 914. In this implementation, the exemplary flow control element 900 comprises a spherical surface 906 at the fluid sealing side 808; and the exemplary flow control element 950 comprises a flat or planar surface 912 at the fluid sealing side 808.

Figure 10A:
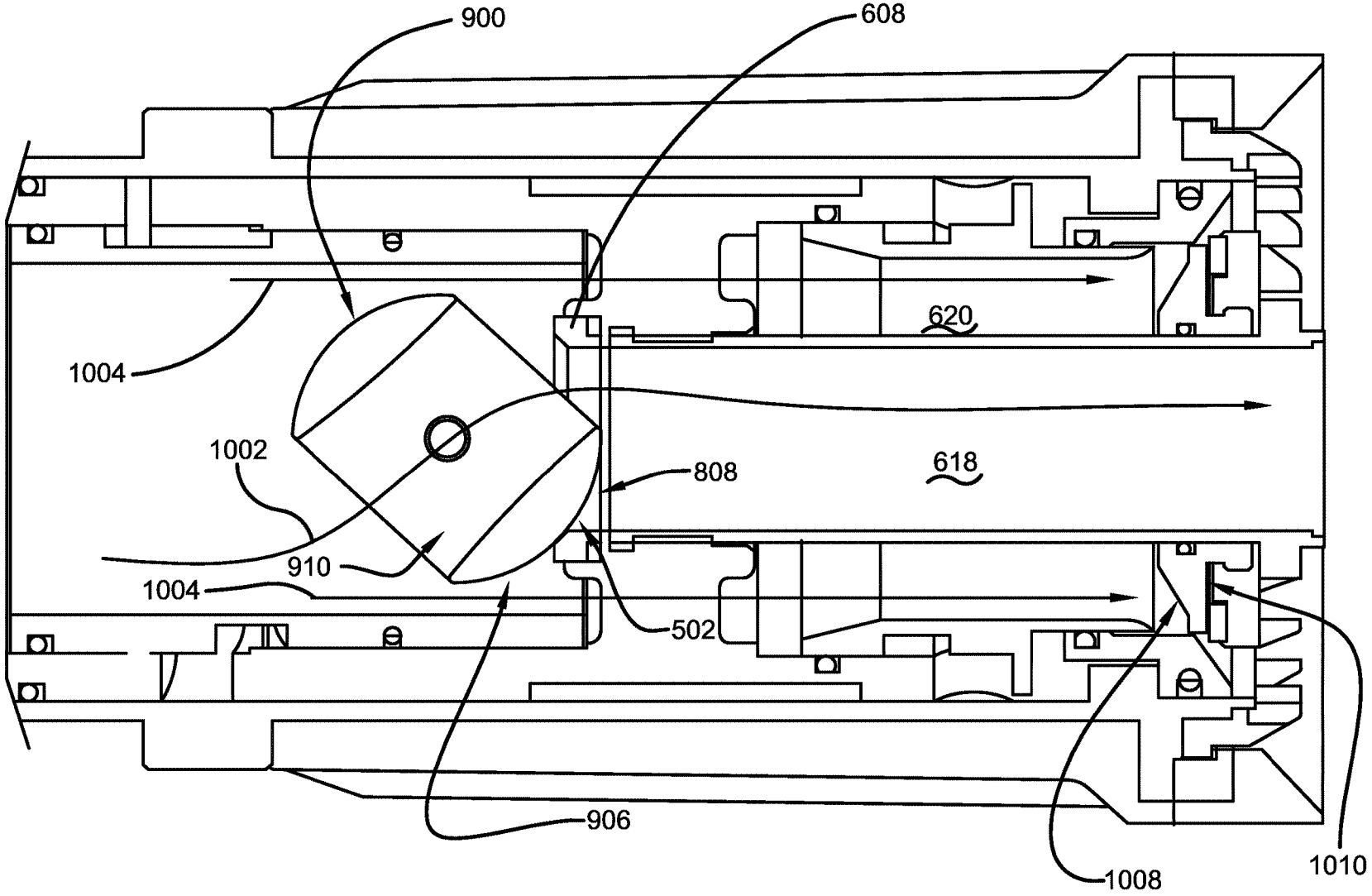
FIGS. 10A and 10B are component diagrams illustrating a side, cut-away view of an example implementation of one or more portions of one or more systems described herein.

As an illustrative example, FIG. 10A illustrates one implementation for the exemplary flow control element 900. In this implementation, the flow control element 900 (e.g., acting as the second flow control element 604 in FIGS. 6A-6C) can be disposed at the upstream end of the straight stream discharge tube 608, at the straight bore seal 502. As illustrated in FIG. 10A, when transitioning between fluid flow to the straight bore passage 618 and fluid flow to the fog pattern passage 620, fluid flows 1002 along the central axis, flow into the ball fluid inlet 910 and the straight bore passage 618; and fluid flows around the ball 1004, toward the fog pattern passage 620. Further, for example, fluid flow 1002 into the ball 900 can push upon the internal surface of the exemplary flow control component 900, which may act against the transition of the element 900 to fluid flow to the fog pattern passage 620. As an example, this may make it more difficult for a user to switch between the two flow patterns, particular under high pressure flow conditions. However, when transitioning from the fog pattern output to the straight stream output, the fluid flow force 1002 against the internal wall of the example ball 900 may facilitate transition to the straight stream.

Figure 10B:
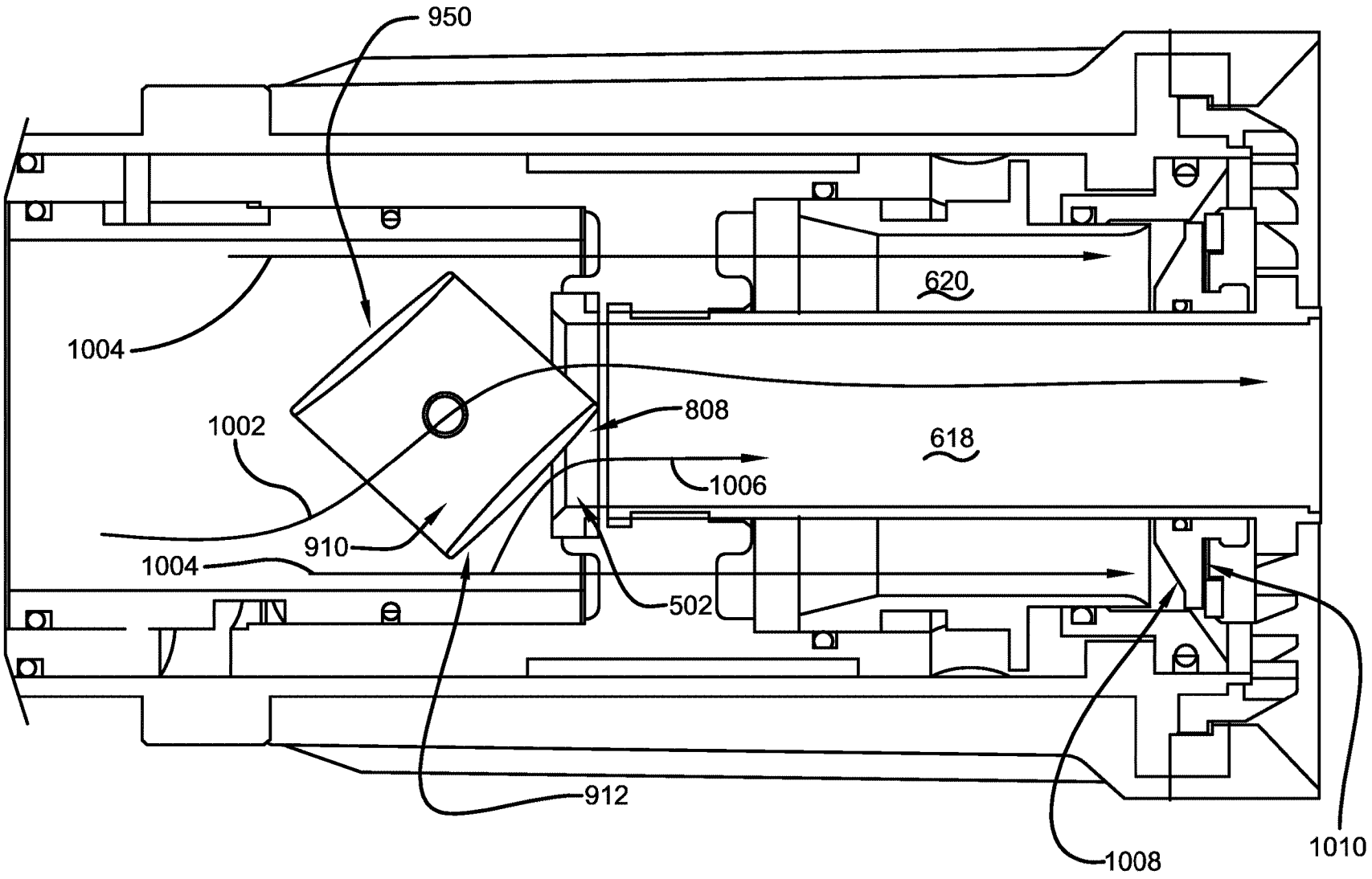

Alternatively, as an illustrative example, FIG. 10B illustrates one implementation for the exemplary flow control element 950. In this implementation, the flow control element 950 (e.g., acting as the second flow control element 604 in FIGS. 6A-6C) can be disposed at the upstream end of the straight stream discharge tube 608, at the straight bore seal 502. As illustrated in FIG. 10B, when transitioning fluid flow between the straight bore passage 618 and the fog pattern passage 620, the example flow control element 950 may allow a second flow 1006 into the straight bore passage 618, past the straight bore seal 502. As illustrated, the example flow control element 950 comprises a flat or planar surface 912 at its fluid sealing side 808, which provides a fluid passage for fluid flow 1006 into the straight bore passage 618. This is in contrast to the flow control element 900 (in FIG. 10A), which comprises a spherical surface 906 at the fluid sealing side 808 of the element 900. In this illustrative example, the fluid passage for fluid flow 1006 into the straight bore passage 618 provided by the flat or planar surface 912 at its fluid sealing side 808, may reduce pressure against the internal wall of the element 950, for example, making it easier for a user to transition the control element (e.g., 604) between straight bore flow and fog pattern flow.

Figure 11A:
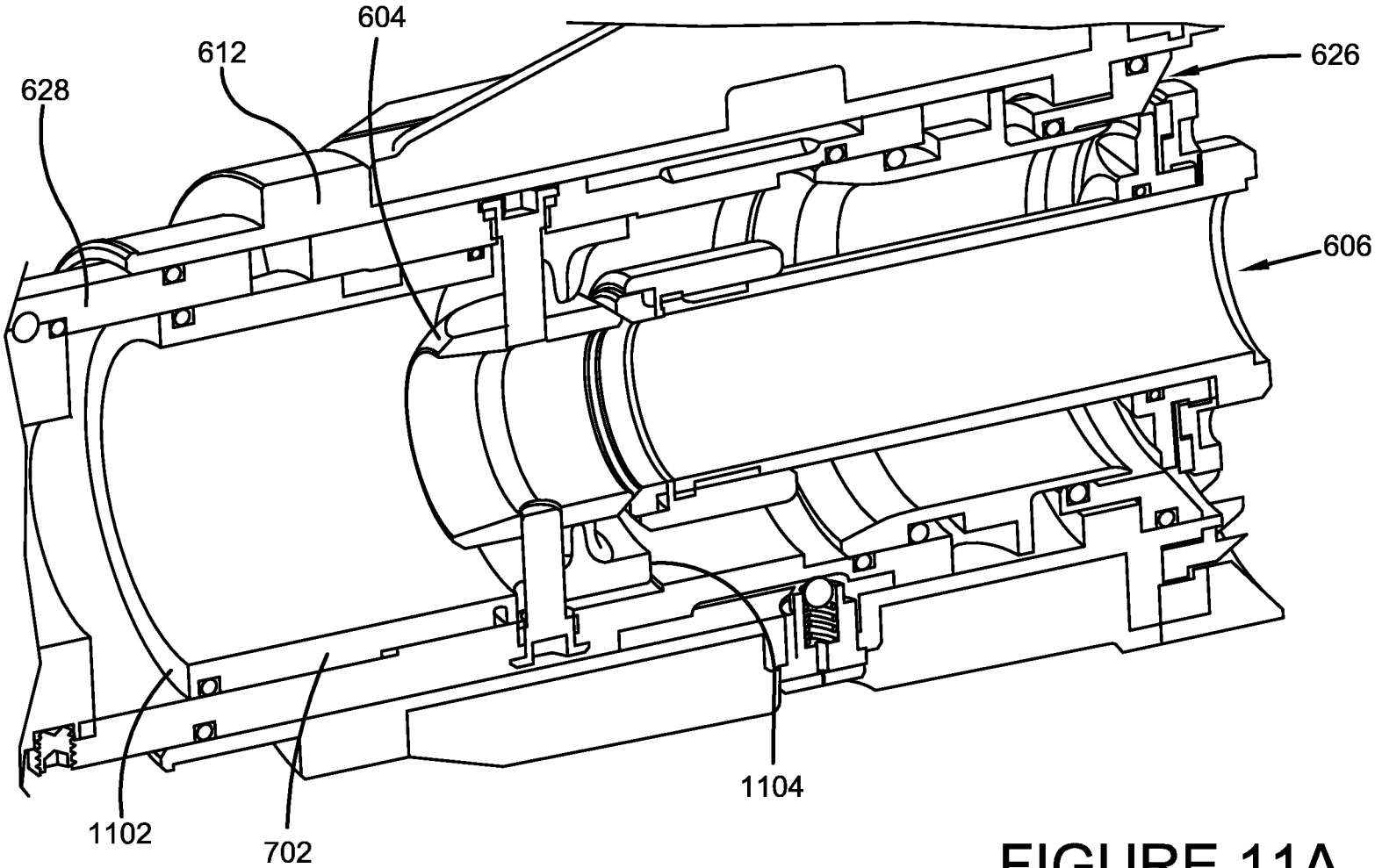
FIG. 11A is a component diagram illustrating a side, sectional view of an example implementation of one or more portions of one or more systems described herein.
Figure 11B:
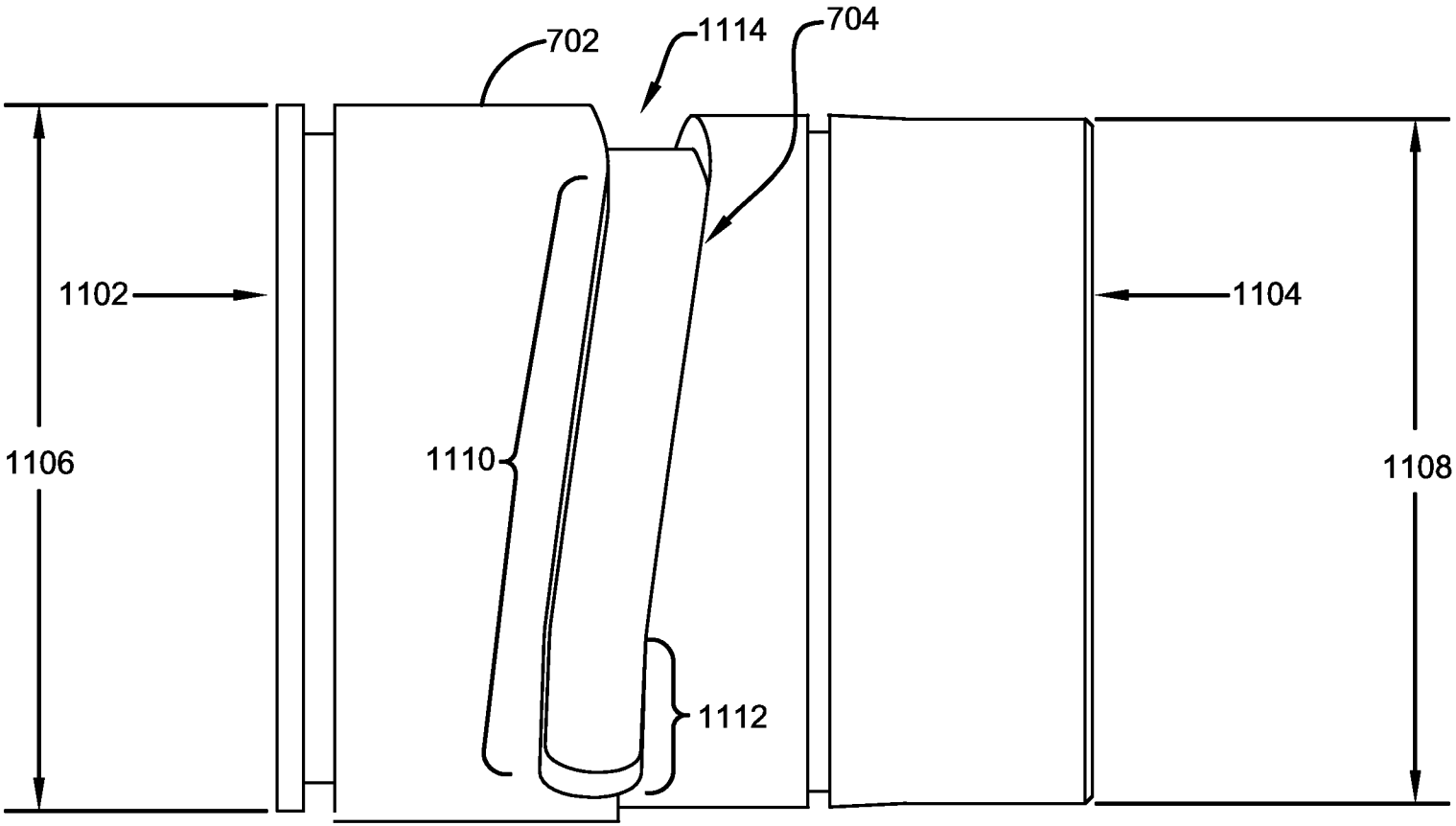
FIG. 11B is a component diagram illustrating a side view of an example implementation of one or more portions of one or more systems described herein.

FIGS. 11A and 11B are component diagrams illustrating an example implementation of the control element actuator 702. In this implementation, the control element actuator 702 can comprise a first end 1102 (e.g., the upstream end) and a second end 1104 (e.g., the downstream end). In one aspect, fluid flow can impact the first end 1102 of the control element actuator 702 during typical operation. As an example, as illustrated in FIG. 11A, the first end 1102 of the control element actuator 702 may be exposed to fluid flow when transitioning between a rearward position (e.g., when the second control element 604 is disposed in a closed position for flow to the straight stream pattern outlet 606) and a forward position (e.g., when the second control element 604 is disposed in an open position for flow to the straight stream pattern outlet 606). In this example, when exposed to the fluid flow, the pressure of the fluid acting against the first end 1102 may facilitate translation of the control element actuator 702 from the rearward to the forward position.

As illustrated in FIG. 11B, the control element actuator 702 can comprise a first diameter 1106, disposed at the first end 1102, and a second diameter 1108 disposed at the second end 1104. In one implementation, the first diameter 1106 can be greater than the second diameter 1108. In this implementation, for example, the first end 1102, comprising the first diameter 1106, which is greater than the second diameter 1108, may allow for a larger surface area to be exposed to the fluid flow during transition of the control element actuator 702 from the rearward to the forward position. In this way, for example, the fluid flow impact on the first end 1102 may provide assistance to the forward transition motion of the control element actuator 702. As described above, when transitioning (e.g., rotating) the second control element 604 from flow to the straight bore passage 618 to the fog pattern passage 620, fluid flow entering the control element inlet 910 may impact the interior wall of the element 900, which can provide resistance against the translation (e.g., rotation) of the ball element. In this implementation, for example, providing a first end 1102 of the control element actuator 702 with a larger surface area (e.g., with the first diameter 1106) can facilitate translation of the control element actuator 702 to the forward position, which, in turn, can facilitate translation of the second flow control element 604 to provide fluid flow to the fog pattern passage 620.

Figure 11C:
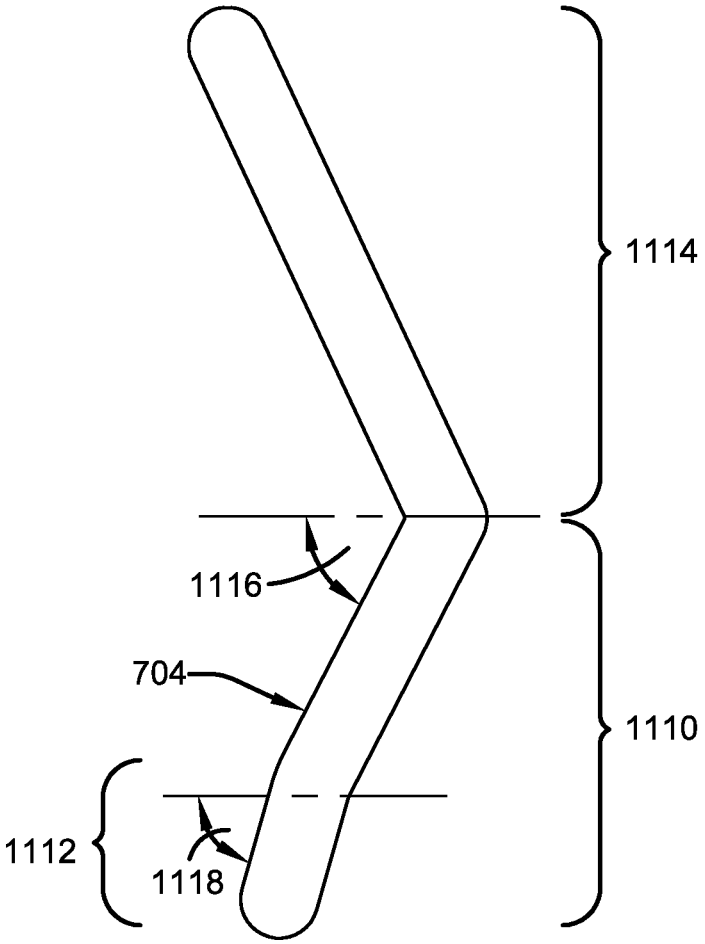
FIG. 11C is a schematic diagram illustrating an example implementation of one or more portions of one or more systems described herein.

In one aspect, the amount of linear translation of the control element actuator 702 in the nozzle body can be defined by the pitch angle of the actuator channel 704 disposed on the control element actuator 702, along with the length of the actuator channel 704. As described above, the roller component 710 is configured to couple with the control element actuator 702 in the actuator channel 704, in slideable and/or a roller-like manner. In that implementation, when the pin component 708 is translated by the pattern sleeve 612, the roller component 710 can slide and/or roll along the actuator channel 704. This can result in translation of the control element actuator 702 in combination with the nozzle body channel 712. As illustrated in FIGS. 11B and 11C, the actuator channel 704 can comprise a transition zone 1110. The transition zone 1110 can comprise the portion of the actuator channel 704 that provides for the transition of the fluid flow between the straight stream and the fog pattern. That is, for example, when the roller component 710 translates along the transition zone 1110, the second flow control element can translate (e.g., rotate) between the open and closed positions for fluid flow to the straight bore passage 618.

As described above, when transitioning from the straight stream pattern to the fog pattern, the pressure increase in the interior of the second flow control element 604 can provide resistance to the completion of the element's translation, to direct flow to the fog pattern passage 620. In one implementation, the transition zone 1110 can comprise a reduced pressure zone 1112, comprising a smaller angle of spiral pitch (e.g., or thread pitch, or slope) than that of the remainder of the transition zone 1110. As an illustrative example, as illustrated in FIG. 11C, the transition zone 1110 of the actuator channel 704 can comprise a first pitch angle 1116 and a second pitch angle 1118. In one implementation, the transition zone 1110 may comprise a length equating to approximately one-hundred and twenty degree rotation around the control element actuator 702 (e.g., or equating to one-hundred and twenty degrees of rotation for the pattern sleeve 612 around the nozzle body 628). In this implementation, for example, the reduced pressure zone 1112 can comprise a thirty degree portion of the one-hundred and twenty degree rotation (e.g., and the remaining portion of the transition zone 1110 can comprise ninety degrees).

Further, in this implementation, the thirty degrees of rotation may approximate the portion of the second control element translation that is subject to the increased pressure from the fluid flow, as described above. As an example, by providing a reduced pitch angle for the actuator channel 704, at the reduced pressure zone 1112, less rotational force may need to be applied to the pattern sleeve 612 to translate the roller component 710 in the actuator channel 704 at that location. In this way, in this example, the increase in pressure on the second flow control element 604 provided by the fluid flow may be at least partially offset by the reduction in force needed to rotate the pattern sleeve 612. That is, a user of the nozzle may find it easier to rotate the pattern sleeve, to switch from straight stream to fog pattern, when the fluid flow rate is maintained during operation (e.g., the user does not need to alter the flow rate in order to switch between stream patterns).

Additionally, in one implementation, the actuator channel can comprise a pattern sleeve adjustment zone 1114. In this implementation, pattern sleeve rotation may be used to adjust flow characteristics of the flog pattern (e.g., and or flush pattern). The pattern sleeve adjustment zone 1114 may allow the roller component 710 to translate in the actuator channel 704, in this zone, without having an effect on the second flow control element 604.

Typically, current nozzles are not able to maintain a constant, matched pressure and flow rate between pattern adjustments. For example, typical nozzles may have flow pressures of fifty pounds per square inch (50 psi) for the straight stream pattern, and 100 psi for the fog pattern, which may necessitate an adjustment of pump pressure to match the nozzle requirements. In one aspect, a nozzle that can be adjusted between a fog pattern and a straight stream pattern can be designed to have a matched flow rate at a matched pressure, at respective outputs during the pattern selection (e.g., while adjusting from the straight stream pattern through the fog pattern). As an example, in this aspect, the nozzle can comprise a one inch (1") diameter discharge tip installed, where the flow rate at fifty pounds per square inch (50 psi) or pressure may be two-hundred and ten gallons per minute (210 gpm). In this example, when the pattern sleeve is translated (e.g., rotated) from a narrow fog pattern to a wide fog pattern position, the pressure and flow should remain substantially the same. In one implementation, in this aspect, the exemplary nozzle can also be calibrated for non-matched flows and pressures. As an example, the straight stream pattern bore can operate at 50 psi, and, when the exemplary nozzle is operated in the fog pattern, the operating pressure can be set up to an alternate pressure.

In one implementation, in this aspect, the diameter (e.g., and/or length) of the straight bore passage tube can determine a resultant flow pressure. As an example, in this implementation, as illustrated in FIGS. 10A and 10B, one or more tubes comprising the straight bore passage 618 can be disposed in the nozzle, where respective tubes have a different diameter (e.g., such as based on what is commonly used in the industry). As another example, a component may be implemented that dynamically adjusts the diameter of the straight stream bore passage 618, such as a restrictor device.

In another implementation, as illustrated in FIGS. 10A and 10B, matching the fog pattern flow pressure and rate to the smooth bore pattern flow rate and pressure may be performed by disposing one or more shims 1010 at the baffle head 1008. In one implementation, the one or more shims 1010 can be added or removed at a downstream end of the baffle head 1008 (e.g., as illustrated in FIGS. 10A and 10B). For example, by adding one or more shims 1010, the baffle head 1008 can be moved further upstream (e.g., left in FIGS. 10A and 10B), which may provide for a decrease flow; while removing one or more shims 1010 can be moved further downstream, (e.g., to the right in the FIGURES) to increase the flow. As an example, in this implementation, the addition or removal of shims 1010 may allow the flow rate and/or pressure through the fog pattern path to substantially match the flow and pressure through the straight bore passage 618. In one implementation, the adjustment of the shims 1010 can be performed at the manufacturer, distributor, and/or during maintenance of the nozzle.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

What is claimed is:

1. A nozzle, comprising:

a first valve configured to control a flow of fluid into the nozzle;

a second valve, disposed downstream from the first valve, and configured to control the flow of fluid between a first fluid outlet and a second fluid outlet;

a pattern sleeve operably coupled with the second valve, and configured to control the second valve using a rotation motion; and a control element actuator operably coupled with the second valve and the pattern sleeve, and the control element actuator disposed in a position offset from an axis of rotation of the second valve, and the control element actuator configured to be translated between a first position and a second position resulting in rotation of the second valve around the axis of rotation, the control element actuator comprising a sleeve having a first diameter at a downstream end and a second diameter at an upstream end, the first diameter greater than the second diameter.

2. The nozzle of claim 1, comprising a transmission, operably coupled with the pattern sleeve, and configured to transmit the rotation motion from the pattern sleeve to the second valve in the form of torque, resulting in rotation of the second valve.

3. The nozzle of claim 1, comprising a roller pin assembly operably coupled with the control element actuator and the pattern sleeve, and configured to translate the control element actuator between the first position and the second position using the rotation motion of the pattern sleeve.

4. The nozzle of claim 3, the control element actuator comprising a cam groove disposed on its outer surface, and configured to slidably couple with the roller pin assembly, the rotation motion resulting in the roller pin assembly traversing along the cam groove, resulting in linear translation of the control element actuator.

5. The nozzle of claim 4, the cam groove comprising a first slope and a second slope, the slope comprising a ratio of distance or rotation around the surface to a distance of translation along the surface, the first slope greater than the second slope, and the location of a transition between the first slope and second slope on the cam groove configured to assist in a transition between the first position and the second position.

6. The nozzle of claim 1, the first position resulting in the second valve directing the flow of fluid to the first fluid outlet, and the second position resulting in the second valve directing the flow of fluid to the second fluid outlet and mitigating the flow of fluid to the first fluid outlet.

7. The nozzle of claim 1, the first fluid outlet comprising a straight bore outlet, and the second fluid outlet comprising a fog pattern outlet.

8. The nozzle of claim 1, the pattern sleeve operably coupled with a nozzle body of the nozzle, and the pattern sleeve configured to translate along the nozzle body as a result of the rotation motion around the nozzle body.

9. The nozzle of claim 8, the translation of the pattern sleeve along the nozzle body resulting in an opening or closing of the second fluid outlet.

10. The nozzle of claim 1, the second valve comprising a spherically-shaped ball valve component, comprising a planar surface disposed at a fluid sealing side of the second valve.

11. The nozzle of claim 1, comprising a fluid inlet controller in which the first valve is disposed.

* * * * *